US012234058B2

(12) United States Patent
Luburic

(10) Patent No.: US 12,234,058 B2
(45) Date of Patent: Feb. 25, 2025

(54) CONTAINER WITH NESTABLE STRUCTURE

(71) Applicant: BWAY Corporation, Atlanta, GA (US)

(72) Inventor: Frano Luburic, Costa Mesa, CA (US)

(73) Assignee: BWAY CORPORATION, Atlanta, GA (US)

( * ) Notice: Subject to any disclaimer, the term of this patent is extended or adjusted under 35 U.S.C. 154(b) by 0 days.

(21) Appl. No.: 18/417,893

(22) Filed: Jan. 19, 2024

(65) Prior Publication Data

US 2024/0383642 A1 Nov. 21, 2024

Related U.S. Application Data

(63) Continuation of application No. 17/254,665, filed as application No. PCT/US2019/040721 on Jul. 5, 2019, now Pat. No. 11,912,463.

(60) Provisional application No. 62/694,262, filed on Jul. 5, 2018.

(51) Int. Cl.

| | |
|---|---|
| ***B65D 21/02*** | (2006.01) |
| ***B65D 1/42*** | (2006.01) |
| ***B65D 25/28*** | (2006.01) |

(52) U.S. Cl.

CPC ..... *B65D 21/0233* (2013.01); *B65D 1/42* (2013.01); *B65D 25/2897* (2013.01)

(58) Field of Classification Search

CPC ..... B65D 21/0233; B65D 25/2897; B65D 2543/00296; B65D 1/42

USPC ..... 206/505, 503, 514; 220/908

See application file for complete search history.

(56) References Cited

U.S. PATENT DOCUMENTS 3,680,735 A * 8/1972 Lucas ..... B65D 21/0215 220/675

2014/0209500 A1* 7/2014 Mays ..... B65D 43/16 206/515

* cited by examiner

*Primary Examiner* — Rafael A Ortiz

*Assistant Examiner* — Sanjidul Islam

(74) *Attorney, Agent, or Firm* — Morris, Manning & Martin, LLP; Daniel E. Sineway, Esq.; Micah B. Hensley, Esq

(57) ABSTRACT

The present disclosure relates generally to containers. In at least one embodiment, the disclosed containers include a nestable structure that can facilitate stacking while limiting reliance on satellite rings. For example, in certain embodiments, a container includes a nestable corner structure with a series of nestable portions. Thus, in these embodiments, more containers can be stacked together in a smaller space, such that shipping and manufacturing processes are more efficient and less costly than with traditional containers.

20 Claims, 21 Drawing Sheets

CONTAINER WITH NESTABLE STRUCTURE

CROSS REFERENCE TO RELATED APPLICATIONS

This application is a continuation of, and claims priority to and the benefit of, U.S. patent application Ser. No. 17/254,665, filed Dec. 21, 2020; entitled "CONTAINER WITH NESTABLE STRUCTURE," which is a national stage entry of, and claims priority to and the benefit of, International Patent Application No. PCT/US2019/040721, filed Jul. 5, 2019, entitled "CONTAINER WITH NESTABLE STRUCTURE," which claims priority to, and the benefit under 35 U.S.C. § 119 of, U.S. Provisional Patent Application No. 62/694,262, filed Jul. 5, 2018, and entitled "CONTAINER WITH NESTABLE STRUCTURE," each of which is incorporated herein by reference in their entireties.

TECHNICAL FIELD

The present disclosure relates generally to containers.

BACKGROUND

Containers are a fundamental component in manufacturing and retailing processes. Containers have been used to store liquids, solids, and gases across a wide range of industries. As such a prevalent component for manufacturers and retailers, improvements to containers may account for significant cost savings to a company's bottom line.

Containers are often transported in bulk, on crates in a stacked i.e., nested, configuration. Traditional containers utilize satellite rings and/or ribs to facilitate the stacking process. These features often decrease the stacking capacity of a container while increasing production cost. However, business and practical concerns encourage increased stacking capacity at a minimal financial trade-off. Therefore, there is a long-felt but unresolved need for containers that provide increased stacking capacity while minimizing the use of satellite rings.

BRIEF SUMMARY OF DISCLOSURE

Briefly described and according to one embodiment, aspects of the present disclosure relate generally to containers, and more particularly to containers that include nestable, step-like corner structures. The present embodiments include a novel and unique container that provides improvements over traditional containers by providing a nestable corner structure that allows for increased stacking capacity, increased strength, lower nest height, lower cost, and faster production times. In various embodiments, the present container design reduces the need for some satellite rings, and provides an improved nesting structure for increased support while minimizing stacking height. Additionally, in particular embodiments, and as will be discussed herein, the present container design provides for decreased stacking height, decreased weight, increased shipping capacity (e.g., containers per pallet, containers per truckload, etc.), shorter manufacturing cycles, larger billboards, and stronger composition.

According to a first aspect, the container may include a bottom including a bottom surface and a bottom perimeter, the bottom perimeter at a first distance from a center of the bottom surface, a sidewall surface extending upwardly from the bottom perimeter at the first distance from the center of the bottom surface to a container bead at a second distance from the center of the bottom surface, and a corner structure including: A) one or more corner structure surfaces; B) a first edge along a first side of the corner structure, the first edge substantially parallel to the sidewall surface; C) a second edge along a second side of the corner structure, the second edge substantially parallel to the sidewall surface; D) a first step surface extending from the sidewall surface inwardly to a first corner structure surface of the one or more corner structure surfaces, the first step surface substantially parallel to the bottom surface; and E) a second step surface extending from the first corner structure surface inwardly to a second corner structure surface of the one or more corner structure surfaces, the second step surface substantially parallel to the bottom surface.

According to a second aspect, the container may include the container of the first aspect or any other aspect, wherein the corner structure includes one or more rib structures extending vertically along a portion of the corner structure.

According to a third aspect, the container may include the container of the second aspect or any other aspect, wherein the one or more rib structures are within an interior of the container.

According to a fourth aspect, the container may include the container of the second aspect or any other aspect, wherein the one or more rib structures are on an exterior of the container.

According to a fifth aspect, the container may include the container of the fourth aspect or any other aspect, wherein the one or more rib structures extend along the first step surface.

According to a sixth aspect, the container may include the container of the first aspect or any other aspect, wherein the corner structure further includes one or more corner structure surfaces along the first edge and the second edge.

According to a seventh aspect, the container may include the container of the sixth aspect or any other aspect, wherein a distance between the first edge and second edge is constant along the corner structure.

According to an eighth aspect, the container may include the container of the sixth aspect or any other aspect, wherein a distance between the first edge and second edge varies throughout the corner structure.

According to a ninth aspect, the container may include the container of the sixth aspect or any other aspect, wherein the sidewall surface slopes inwardly to the one or more corner structure surfaces along the first edge and the second edge.

According to a tenth aspect, the container may include the container of the first aspect or any other aspect, wherein an exterior edge of the first step includes a first radius.

According to an eleventh aspect, the container may include the container of the tenth aspect or any other aspect, wherein an exterior edge of the second step includes a second radius.

According to a twelfth aspect, the container may include the container of the eleventh aspect or any other aspect, wherein the first and second radius are the same radius.

According to a thirteenth aspect, the container may include the container of the first aspect or any other aspect, wherein the bottom surface is substantially rectangular.

According to a fourteenth aspect, the container may include the container of the first aspect or any other aspect, wherein the bottom surface is substantially circular.

According to a fifteenth aspect, the container may include a bottom perimeter, a top container edge, and a corner structure including: A) one or more corner structure surfaces; B) a first edge along a first side of the corner structure, the first edge substantially parallel to a sidewall surface, the sidewall surface extending upwardly from the bottom perimeter to the top container edge; C) a second edge along a second side of the corner structure, the second edge substantially parallel to the sidewall surface; D) a first step surface extending from the sidewall surface inwardly to a first corner structure surface of the one or more corner structure surfaces, the first step surface substantially perpendicular to the first step surface; and E) a second step surface extending from the first corner structure surface inwardly to a second corner structure surface of the one or more corner structure surfaces, the second step surface substantially perpendicular to the second step surface.

According to a sixteenth aspect, the container may include the container of the fifteenth aspect or any other aspect, wherein the corner structure includes one or more rib structures extending vertically along a portion of the corner structure.

According to a seventeenth aspect, the container may include the container of the sixteenth aspect or any other aspect, wherein the one or more rib structures are within an interior of the container.

According to an eighteenth aspect, the container may include the container of the sixteenth aspect or any other aspect, wherein the one or more rib structures are on an exterior of the container.

According to a nineteenth aspect, the container may include the container of the eighteenth aspect or any other aspect, wherein the one or more rib structures extend along the first step surface.

According to a twentieth aspect, the container may include the container of the fifteenth aspect or any other aspect, wherein the corner structure further includes one or more corner structure surfaces along the first edge and the second edge.

According to a twenty-first aspect, the container may include the container of the twentieth aspect or any other aspect, wherein a distance between the first edge and second edge is constant along the corner structure.

According to a twenty-second aspect, the container may include the container of the twentieth aspect or any other aspect, wherein a distance between the first edge and second edge varies throughout the corner structure.

According to a twenty-third aspect, the container may include the container of the twentieth aspect or any other aspect, wherein the sidewall surface slopes inwardly to the one or more corner structure surfaces along the first edge and the second edge.

According to a twenty-fourth aspect, the container may include the container of the fifteenth aspect or any other aspect, wherein an exterior edge of the first step includes a first radius.

According to a twenty-fifth aspect, the container may include the container of the twenty-fourth aspect or any other aspect, wherein an exterior edge of the second step includes a second radius.

According to a twenty-sixth aspect, the container may include the container of the twenty-fourth aspect or any other aspect, wherein the first and second radius are the same radius.

According to a twenty-seventh aspect, the container may include the container of the fifteenth aspect or any other aspect, wherein the bottom surface is substantially rectangular.

According to a twenty-eighth aspect, the container may include the container of the fifteenth aspect or any other aspect, wherein the bottom surface is substantially circular.

According to a twenty-ninth aspect, the container may include an interior bottom perimeter, a top container edge, a first sidewall section extending from the interior bottom perimeter to the top container edge, a second sidewall section extending from the interior bottom perimeter to the top container edge, and one or more steps bisecting the first sidewall section and the second sidewall section, each of the one or more steps including: A) a first edge and a second edge defining a step surface; and B) the step surface, wherein the step surface extends from the first sidewall section to the second sidewall section.

According to a thirtieth aspect, the container may include the container of the twenty-ninth aspect or any other aspect, wherein the container further includes one or more rib structures extending along at least a portion of the one or more steps.

According to a thirty-first aspect, the container may include the container of the twenty-ninth aspect or any other aspect, wherein the one or more steps include a first step and second step, the first step surface extends a first distance from the first sidewall section to the second sidewall section, and the second step surface extends a second distance from the first sidewall section to the second sidewall section.

According to a thirty-second aspect, the container may include the container of the thirty-first aspect or any other aspect, wherein the first distance and second distance are substantially the same.

According to a thirty-third aspect, the container may include the container of the thirty-first aspect or any other aspect, wherein the first distance and the second distance are different distances.

According to a thirty-fourth aspect, the container may include the container of the thirty-first aspect or any other aspect, wherein the first edge of the first step includes a first radius.

According to a thirty-fifth aspect, the container may include the container of the thirty-fourth aspect or any other aspect, wherein the first edge of the second step includes a second radius.

According to a thirty-sixth aspect, the container may include the container of the thirty-fifth aspect or any other aspect, wherein the first and second radius are the same radius.

According to a thirty-seventh aspect, the container may include the container of the twenty-ninth aspect or any other aspect, wherein the interior bottom perimeter is substantially rectangular.

According to a thirty-eighth aspect, the container may include the container of the twenty-ninth aspect or any other aspect, wherein the interior bottom perimeter is substantially circular.

According to a thirty-ninth aspect, the container may include a bottom, the bottom including one or more indented grooves, wherein the one or more indented grooves extend from a first sidewall to an opposite sidewall; one or more sidewalls forming an opening at a top edge of the one or more sidewalls, the one or more sidewalls including a nestable structure, the nestable structure including two or more rectangular pallets wherein the bottom portion of each rectangular pallet protrudes further out from the one or more sidewalls than the top portion of each rectangular pallet; wherein the top edge of the one or more sidewalls includes a container bead, the container bead for sealing the container when a removable lid is affixed.

According to a fortieth aspect, the container may include the container of the thirty-ninth aspect or any other aspect, wherein the two or more rectangular pallets include an outward curve along a horizontal diameter of each rectangular pallet.

According to a forty-first aspect, the container may include the container of the fortieth aspect or any other aspect, wherein a radius of the outward curve of each rectangular pallet of the two or more rectangular pallets is the same.

According to a forty-second aspect, the container may include the container of the thirty-ninth aspect or any other aspect, wherein the nestable structure includes one or more vertical ribs extending a length of the one or more sidewalls.

According to a forty-third aspect, the container may include the container of the forty-second aspect or any other aspect, wherein the one or more vertical ribs are on the inside of the container.

According to a forty-fourth aspect, the container may include the container of the forty-second aspect or any other aspect, wherein the one or more vertical ribs are on the outside of the container.

According to a forty-fifth aspect, the container may include the container of the thirty-ninth aspect or any other aspect, wherein an upper portion of the container below the opening includes one or more satellite rings around a circumference of the upper portion of the container.

According to a forty-sixth aspect, the container may include the container of the thirty-ninth aspect or any other aspect, wherein the opening is substantially rectangular.

According to a forty-seventh aspect, the container may include the container of the thirty-ninth aspect or any other aspect, wherein the opening is substantially square.

According to a forty-eighth aspect, the container may include the container of the thirty-ninth aspect or any other aspect, wherein the opening is substantially circular.

According to a forty-ninth aspect, the container may include a bottom, a sidewall, and an opening, wherein the sidewall includes a nestable structure, the nestable structure including a plurality of steps along a corner of the container, wherein each step is outwardly curved and each curve includes an equivalent radius.

According to a fiftieth aspect, the container may include a bottom, a sidewall, and an opening, wherein the sidewall includes a nestable structure, the nestable structure including a plurality of steps along a corner of the container, wherein each step is inwardly curved and each curve contains a smaller radius than the curve immediately above it.

According to a fifty-first aspect, the container may include a bottom, a sidewall, and an opening, wherein the sidewall includes a nestable structure, the nestable structure including a plurality of steps along a corner of the container, wherein each step includes a trapezoidal protrusion, wherein each trapezoidal protrusion is flatter and less trapezoidal than the trapezoidal protrusion immediately above it.

These and other aspects, features, and benefits of the claimed embodiment(s) will become apparent from the following detailed written description of the embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
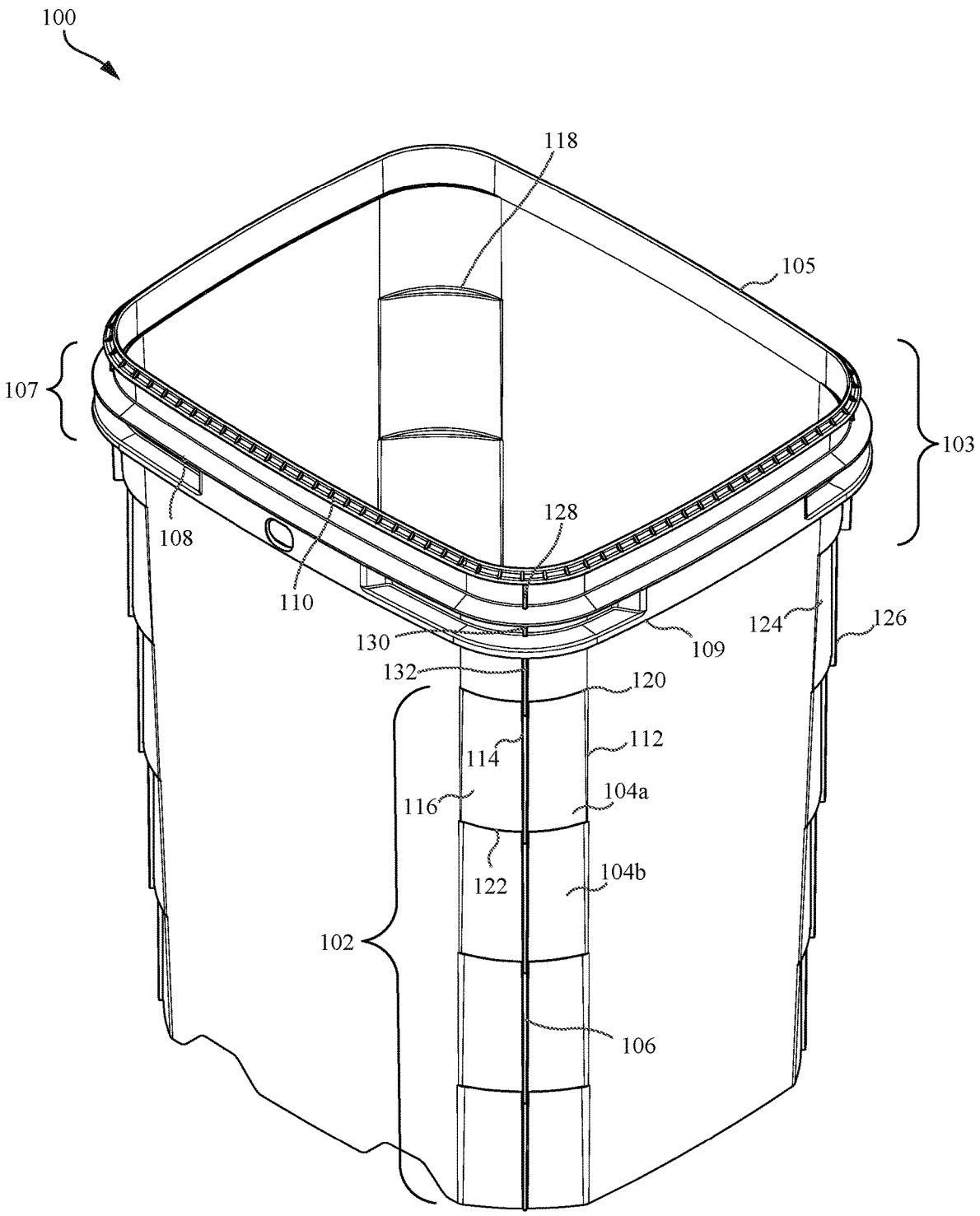
FIG. 1 is a perspective view of an exemplary rectangular-shaped container, according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with, and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

The above and further features of the disclosed exemplary container will be recognized from the following detailed descriptions and drawings of particular embodiments. In one or more embodiments, a container with one or more nestable corner structures is disclosed. As will be understood from discussions herein, the term "nestable structure" may be used interchangeably with "corner structure" or "nestable corner structure." Further, the shape of a container will not exclude it from having a "corner structure" (e.g., a substantially circular container may include a "corner structure" or a "nestable structure" as described herein).

In particular embodiments, the nestable corner structures include a step-like feature for at least improved stacking capability. In various embodiments, to provide additional load support, the nestable corner structure of the container may include one or more corner ribs. In at least one embodiment, the container includes a large billboard that forms the outer casing of the container. In some embodiments, the container includes a container bead around a rim of the container for increased sealant properties. In certain embodiments, the container may include one or more satellite rings to facilitate tamper prevention and/or container nesting. According to at least one embodiment, the container includes handgrips to facilitate carrying the container. In a particular embodiment, the container may include a provision for handle attachments to provide a mechanism for attaching a handle to the container. According to at least one embodiment, the container is substantially rectangular in shape. In particular embodiments, the container is substantially circular in shape.

The container discussed herein may be formed in any suitable way. In various embodiments, the container is formed by injection molding. In particular embodiments, the container is 3D-printed or created via other additive manufacturing techniques. In further embodiments, various components of the container are formed or created separately, and the various components of the container are joined or otherwise suitably connected to form the container. In one embodiment, the container may be one piece and unitary.

Additionally, the container may be formed from any suitable material. In various embodiments, the container is manufactured from plastic (e.g., polyethylene, high-density polyethylene, etc.). In particular embodiments, the container is manufactured from a metal or composite material.

First Exemplary Embodiment

Turning now to FIG. 1, a perspective view of an exemplary rectangular-shaped container 100 is shown, according to one embodiment of the present disclosure. In particular embodiments, the container 100 may include a nestable structure 102. As shown in FIG. 1, the nestable structure 102 may include one or more portions 104 (e.g., three portions, five portions, eight portions, etc.) whereby each portion 104 includes one or more steps. For example, as shown in FIG. 1, an exemplary container may include nestable structure portions, 104*a* and 104*b*.

In various embodiments, each of the one or more portions 104 (e.g., 104*a* and 104*b*) includes a surface 116, a top edge 120, a bottom edge 122, and one or more side edges 112. In at least one embodiment, the surface 116 is of a substantially convex shape with respect to a sidewall (e.g., billboard, as will be further described herein) of the container. As will be understood, the surface 116 has a substantially convex shape (e.g., is curved) includes at least one radius, corresponding to a radius of the top edge 120 and/or bottom edge 122. In various embodiments, each surface 116 has substantially similar curvature as the preceding surface 116 to facilitate container nesting (e.g., below the bumper), as the surface 116 provides adequate contact surfaces for both secure nesting and case of removal.

In at least one embodiment, the portions of the nestable structure 104 are staggered, whereby the top edge 120 of each portion 104 protrudes outwardly further from a center of the container than the bottom edge 122. As will be understood from discussions herein, the staggered nature of the portions of the nestable structure 102 may form one or more step-like features 118 on an interior of the container. As will be further understood, each of the one or more steps 118 correspond to an edge of a portion on the exterior of the container (e.g., top edge 120 and bottom edge 122).

In some embodiments, a bottom edge of a portion (e.g., bottom edge 122) forms the top edge of a vertically adjacent portion. In this way, each portion is staggered, such that each portion is progressively closer a center of the container (e.g., from top to bottom).

In at least one embodiment, the sides (e.g., edge 112) of the nestable structure 102 are substantially parallel to the outer sidewall of the rectangular-shaped container 100.

In some embodiments, the staggered nature of the portions 104 and the steps thereof provide reinforcement while using less material than traditional containers, as traditional containers may include more protruding satellite rings and thicker sidewalls. In some embodiments, the staggered nature of the portions 104 and the steps thereof may also facilitate nesting at a lower height than traditional containers because an interior container may rest on the interior portion surfaces 118 of the nestable structure of an exterior container in the stacking configuration. In various embodiments, a nestable structure (e.g., nestable structure 102) may be included on any or all corners of the substantially rectangular-shaped container (or on any portions of a substantially circular-shaped container).

Additionally, in the embodiment shown in FIG. 1, the container includes a single corner rib 106 on the outside of the container, extending vertically along the nestable structure 102, along portions of the sidewall, between satellite rings, and between the satellite rings and the container bead 110, to increase the strength and structural integrity of the rectangular-shaped container. In certain embodiments, each portion 104 of the nestable structure 102 includes a rib portion (e.g., rib portions 114 and 126) extending from and/or along the surface (e.g., surfaces 116 and 124) of the portion 104. In particular embodiments, the corner rib 106 may be staggered in accordance with the nestable structure 102, so as not to function as an impediment when containers are nested. In one embodiment, the corner rib 106 may be included on the outside of the container. In another embodiment, the corner rib 106 may be included on the inside of the container. In yet another embodiment, the corner rib 106 may be included on both the outside and inside of the container. In particular embodiments, and as shown in FIG. 1, the corner rib 106 extends the length of the rectangular-shaped container 100 from a bottom edge to a container bead 110. In various embodiments, the length of the corner rib 106 may vary, such that load support and stability may be optimized. In one or more embodiments, the rectangular-shaped container 100 may include more than one corner rib (e.g., two corner ribs, three corner ribs, etc.) on the inside and/or the outside of the container. In one embodiment, one or more corner ribs 106 may be centrally located on a portion of a corner structure (e.g., substantially passing through a center point of a top and bottom edge of the portion 104). In particular embodiments, one or more corner ribs 106 may be located off-set from a center of a portion 104 of a corner structure.

Continuing with FIG. 1, in various embodiments, the exemplary rectangular-shaped container may include a satellite ring assembly 107 around the upper portion 103 of the container 100. In particular embodiments, the satellite ring assembly 107 may include at least one upper satellite ring 108 and one lower satellite ring 109 protruding outwardly from the outer surface of the upper portion 103 of the rectangular-shaped container 100. In at least one embodiment, the satellite ring assembly 107 includes one or more hand grips (e.g., hand grip 404 as further discussed herein). In various embodiments, the corner rib 106 extends through or around portions of the satellite ring assembly 107. As shown in FIG. 1, a portion 130 of the corner rib 106 is located between portions of the satellite ring assembly 107. In some embodiments, a portion 128 of the corner rib 106 is above the satellite ring assembly 107. In at least one embodiment, a portion 130 of the corner ribs 106 is located on the surface of the outer sidewall (e.g., billboard) of the rectangular-shaped container 100.

In certain embodiments, the satellite ring assembly 107 limits disruption of each container's components when one or more rectangular-shaped containers 100 are placed next to each other by providing a barrier between the containers. In these embodiments (and others), this feature allows for more containers to fit on a pallet or otherwise to be shipped concurrently. In particular embodiments, the satellite ring assembly 107 may include a tamper evident satellite ring, such that when the rectangular-shaped container 100 is sealed with a lid, the tamper evident satellite ring serves as a barrier to prevent any attempts to remove the lid by reaching under the lid.

In various embodiments, and as shown in FIG. 1, the exemplary rectangular-shaped container 100 includes a container bead 110 located around the rim 105 of the rectangular-shaped container 100. In particular embodiments, the container bead 110 facilitates a liquid-tight seal when the rectangular-shaped container 100 is sealed with a rectangular-shaped container lid. In one embodiment, the container bead 110 may include one or more gaskets for increased sealing properties. In another embodiment, the container bead 110 may be gasket-less, such that a liquid-tight seal may be obtained without the use of a gasket and/or other additional sealing component as discussed in U.S. patent application Ser. No. 16/245,105, filed on Jan. 10, 2019, and entitled "CONTAINER AND CONTAINER LID WITH BUILT-IN BRINE DISC," incorporated herein by reference in its entirety.

Figure 2:
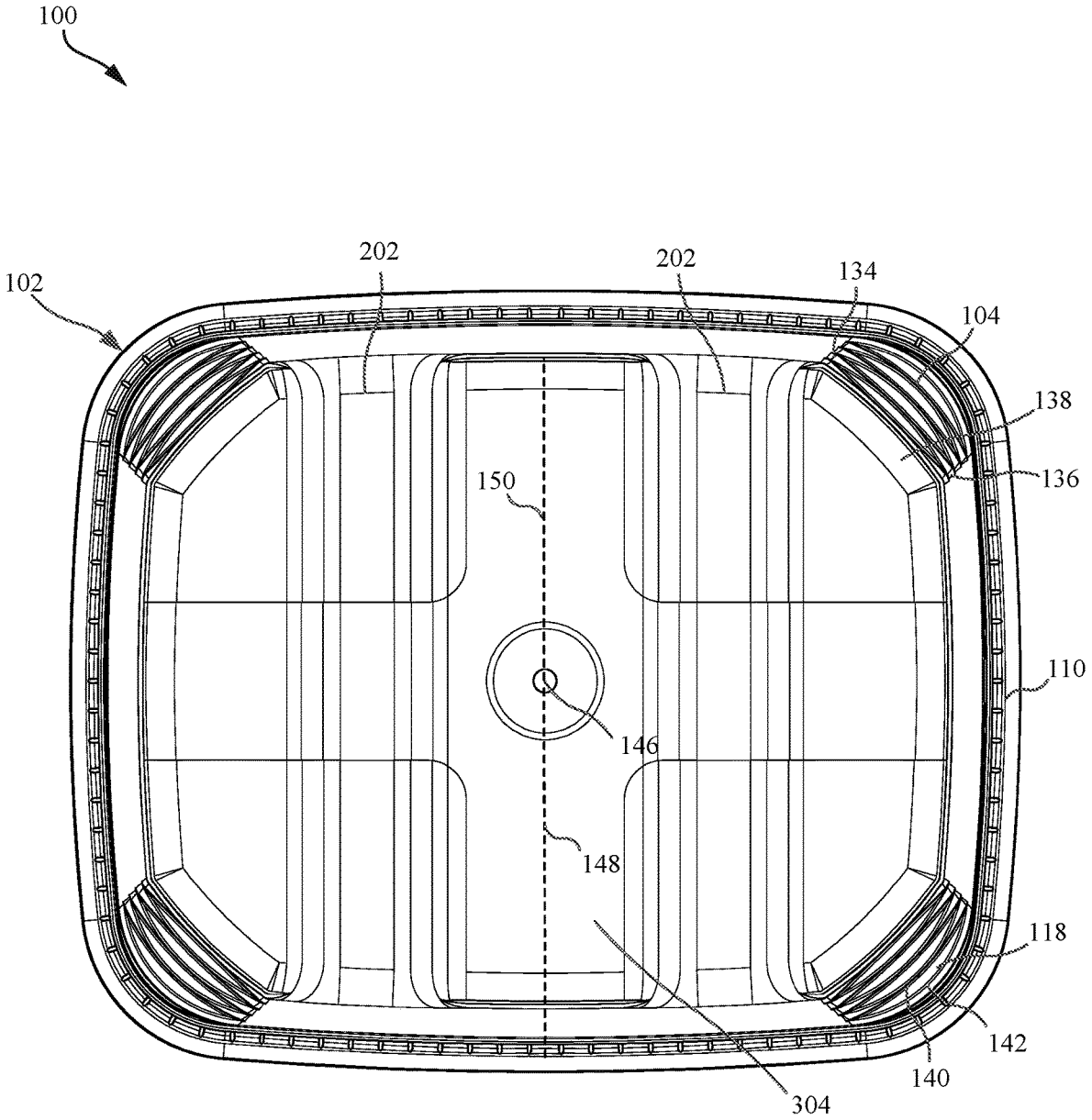
FIG. 2 is a top view of an exemplary rectangular-shaped container, according to one embodiment of the present disclosure.

Turning now to FIG. 2, a top view of an exemplary rectangular-shaped container 100 is shown, according to one embodiment of the present disclosure. In various embodiments, the exemplary rectangular-shaped container 100 includes indented grooves 202 at the bottom of the container to provide a stable base for the container when the container is resting on a surface. In particular embodiments, the indented grooves 202 extend from one wall of the container bottom to the opposite wall of the container bottom.

In various embodiments, the rectangular-shaped container 100 includes a bottom surface 304 with a center 146. In a particular embodiment, the point between the bottom surface and the perimeter of the bottom surface is a particular distance 150 from the center 146 along the bottom surface 304. In some embodiments, the container bead 110 is at a second particular distance 148 from the center 146.

In certain embodiments, and as shown in FIG. 2, the exemplary rectangular-shaped container 100 includes a nestable structure 102 that includes a series of nestable portions 104. In one or more embodiments, the nestable portions 104 may form a series of internal shelves (e.g., interior steps 118) that facilitate nesting. In some embodiments, the bottom edge (e.g., bottom edge 122) of each portion is substantially parallel to the bottom surface 304 of the rectangular-shaped container 100. In certain embodiments, an interior step 118 is formed where the bottom edge of each portion 104 connects to the outer sidewall of the rectangular-shaped container 100. In at least one embodiment, the interior step 118 is substantially semi-circular. In certain embodiments, the interior step 118 may include curved edges 140 and 142, which form a step surface.

In particular embodiments, the nestable structure 102 may be included on one or more sides of the rectangular-shaped container 100. In certain embodiments, the nestable structure 102 extends from the container bottom to the container rim 105. In at least one embodiment, the nestable structure 102 includes an interior edge 138 that is substantially perpendicular to the bottom surface 304 of the container. In various embodiments, the nestable structure 102 may include substantially parallel sides (e.g., interior edges 134 and 136).

Figure 3:
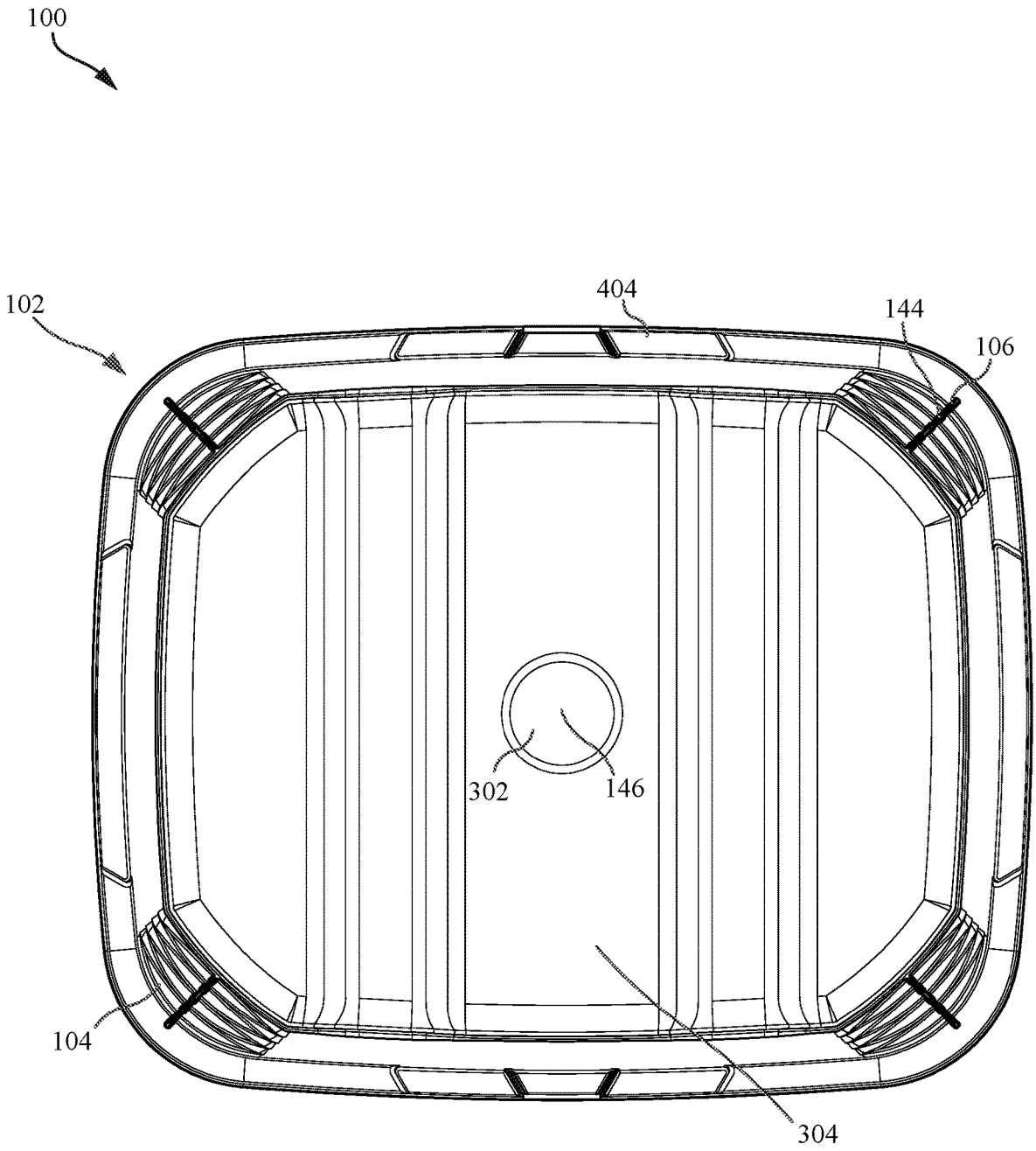
FIG. 3 is a bottom view of an exemplary rectangular-shaped container, according to one embodiment of the present disclosure.

FIG. 3 shows a bottom view of an exemplary rectangular-shaped container 100, according to one embodiment of the present disclosure. In particular embodiments, the exemplary rectangular-shaped container 100 includes a container bottom dimple 302 of circular shape to increase stability. In one or more embodiments, the container bottom dimple 302 may be of any suitable size or shape.

In various embodiments, and as shown in FIG. 3, a corner rib 106 may be included on each corner of a rectangular-shaped container 100. In at least one embodiment, the corner rib 106 extends vertically along the surface of each portion 104 of the nestable structure 102. In some embodiments, a corner rib 106 may partially extend along the surface of each portion of the nestable structure 102 (e.g., the corner rib extends along an upper section of the surface of each portion, etc.). In some embodiments, a portion 144 of the corner rib 106 may partially extend along a bottom surface of the nestable structure. In certain embodiments, a corner rib 106 may be included on less than all corners of the rectangular-shaped container 100. In particular embodiments, more than one corner rib 106 may be included on any or all corners of the rectangular-shaped container 100. In one embodiment, the corner rib 106 may pass through a midpoint of a radius of one of the portions (or all of the portions)

of the nestable structure 102. In certain embodiments, the corner rib 106 may be off-center and/or extend vertically at an angle.

In various embodiments, and as shown in FIG. 3, the rectangular-shaped container 100 may include a hand grip 404 to facilitate carrying the container. In one embodiment, the hand grip may be substantially trapezoidal in shape. In another embodiment, the hand grip 404 may be any suitable shape. In particular embodiments, the hand grip 404 may include a substantially trapezoidal area of space centrally located within the hand grip to provide support for one or more fingers to engage with the hand grip 404.

Figure 4:
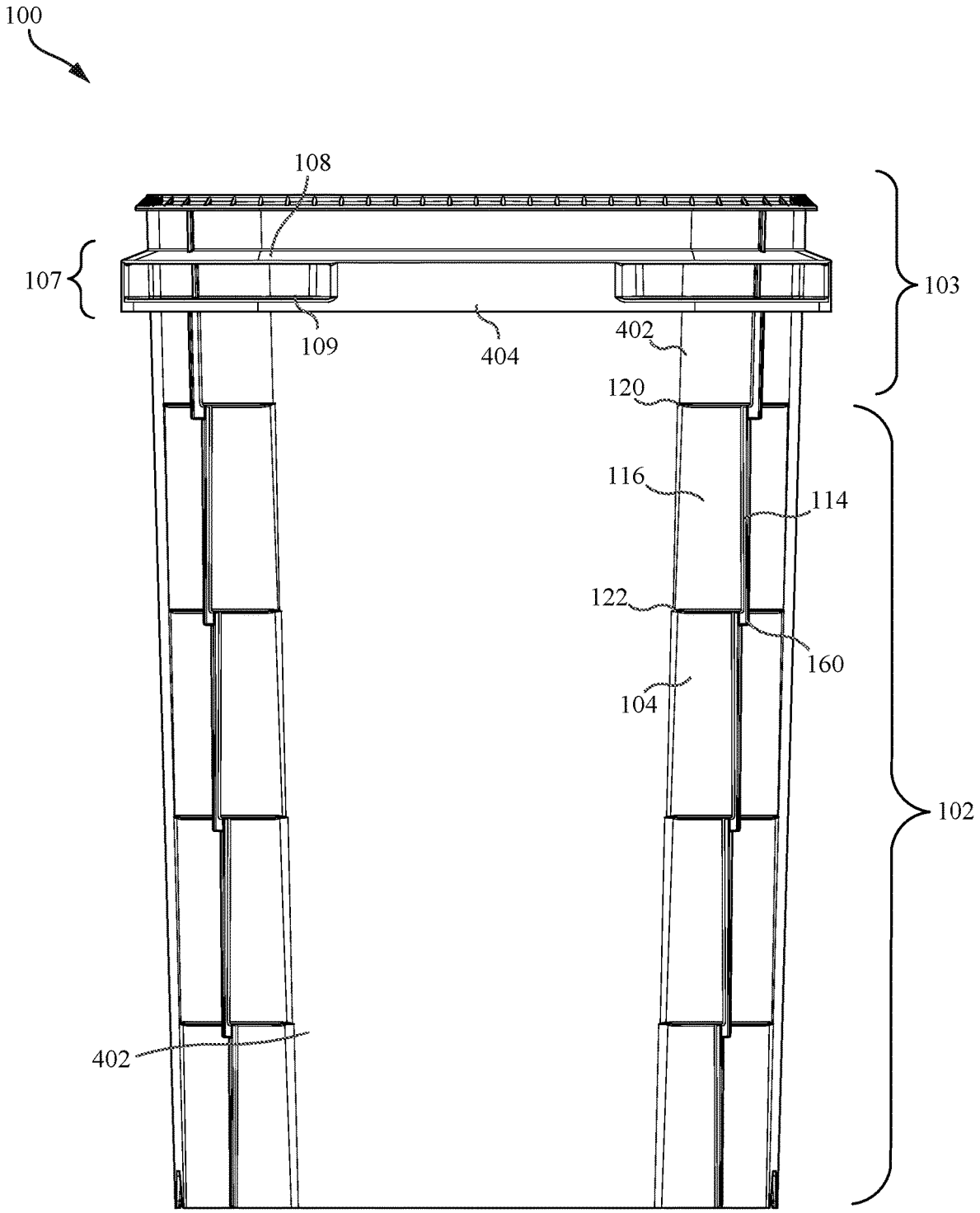
FIG. 4 is a side view of an exemplary rectangular-shaped container, according to one embodiment of the present disclosure.

Referring now to FIG. 4, a side view of an exemplary rectangular-shaped container 100 is shown, according to one embodiment of the present disclosure. In one or more embodiments, the exemplary rectangular-shaped container includes a billboard (e.g., sidewall) 402 on all four sides to enclose the rectangular-shaped container 100 and provide a solid base for stability. In some embodiments, the billboard 402 may be larger than on traditional containers because less satellite rings are included in these embodiments (and others) than on traditional containers. In some embodiments, the billboard may include graphical information (e.g., signage).

In particular embodiments, the rectangular-shaped container 100 may include a corner rib 114 along the surface 116 of a portion 104 of the nestable structure 102. In various embodiments, the corner rib 114 may include a corner rib overhang 160. In one or more embodiments, the corner rib overhang 160 extends downwardly from the bottom edge 122 of a first portion 104 of the nestable structure 102.

Additionally, in particular embodiments, the rectangular-shaped container 100 may include a hand grip 404 within the satellite assembly 107 to facilitate carrying the container. In one or more embodiments, the hand grip 404 may be located on the upper portion 103 of the exterior of the rectangular-shaped container 100, immediately above a lower satellite ring 109 and/or below an upper satellite rings 108 within the satellite assembly 107, and approximately midway between the far left and far right points of the upper portion 103 of the exterior of the rectangular-shaped container. In at least one embodiment, and as shown in FIG. 4, the hand grip 404 may be integrally connected to the upper satellite ring 108 and the lower satellite ring 109. In some embodiments, the hand grip 404 includes a substantially flat and/or rigid structure substantially parallel to the billboard 402 included on the same side as the hand grip 404. In certain embodiments, the hand grip 404 includes an empty space between the outer surface of the sidewall of the rectangular-shaped container 100 and the inner surface of the hand grip 404, whereby a user's fingers may be inserted into the empty space such that the user may grab the hand grip 404. In particular embodiments, a hand grip 404 may be located on one or more sides of the rectangular-shaped container 100. In one embodiment, a hand grip 404 is located on all sides of the rectangular-shaped container 100.

Figure 5:
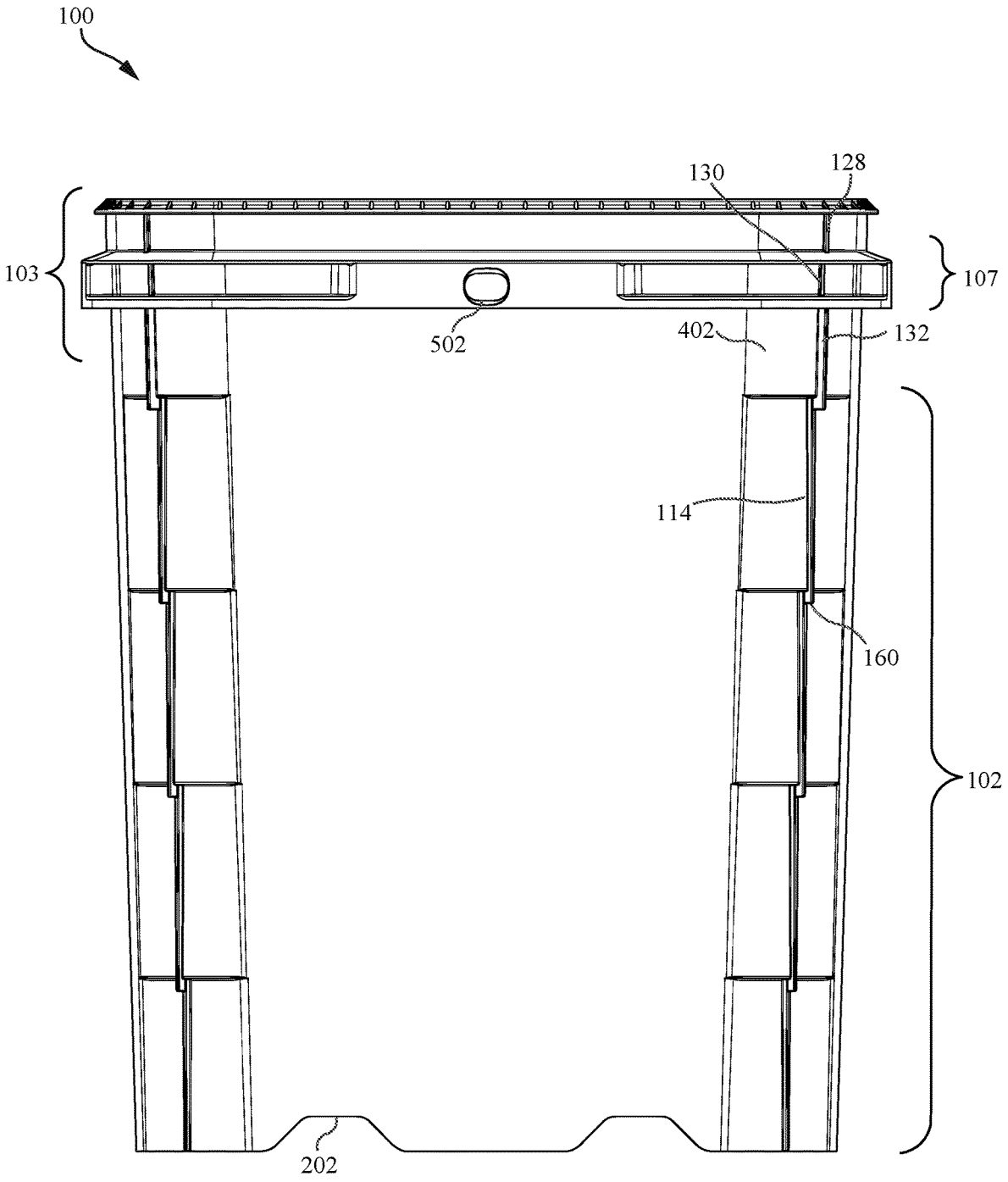
FIG. 5 is a side view of an exemplary rectangular-shaped container, according to one embodiment of the present disclosure.

FIG. 5 shows a side view of an exemplary rectangular-shaped container 100, according to one embodiment of the present disclosure. In various embodiments, the rectangular-shaped container 100 may also include a provision for a handle attachment 502 to facilitate carrying the container. In one or more embodiments, the provision for the handle attachment 502 includes an opening or depression of varying shapes and sizes that allows for the attachment of a handle that can be used for carrying the rectangular-shaped container 100. In one or more embodiments, the provision for the handle attachment 502 may be located on the upper portion 103 of the exterior of the rectangular-shaped container 100 within the satellite ring assembly 107. In particular embodiments, the provision for the handle attachment 502 may be located on one or more sides of the rectangular-shaped container 100. In one embodiment, a provision for the handle attachment 502 is located on all sides of the rectangular-shaped container 100.

FIG. 5 shows the indented grooves 202 at the bottom of the rectangular-shaped container 100. In the embodiment shown, the rectangular-shaped container 100 includes two indented grooves. In various embodiments, the rectangular shaped container may include more or less than two indented grooves (e.g., one indented groove, four indented grooves, etc.).

In particular embodiments, and as discussed above, the rectangular-shaped container 100 may include at least one corner rib 114 on the outside and/or inside of the container. In one or more embodiments, the corner rib 114 may be any suitable shape. In at least one embodiment, the corner rib 114 is substantially rectangular in shape, extending outwardly from surfaces of the nestable structure 102 and/or a sidewall of the container. In various embodiments, the corner rib 114 may extend vertically along the surface of each portion 104 of the nestable structure 102. In some embodiments, the corner rib 114 may traverse the underside of each portion 104 of the nestable structure 102, such that the corner rib 114 may extend below the bottom of each portion 104 (e.g., corner rib overhang 160). In one embodiment, the corner rib 160 forms a substantially right angle where it traverses from the surface of a portion 104 (e.g., a surface substantially perpendicular to a bottom surface of the container) to the underside surface of the rectangular portion 104. In various embodiments, the corner rib 114 extends through or between portions of the satellite ring assembly 107. In particular embodiments, a portion 130 of the corner rib 114 is located between the satellite ring assembly 107. In some embodiments, a portion 128 of the corner rib 114 is located above the satellite ring assembly 107. In at least one embodiment, a portion 132 of the corner ribs 114 is located on the surface of the billboard 402 of the rectangular-shaped container 100.

Figure 6:
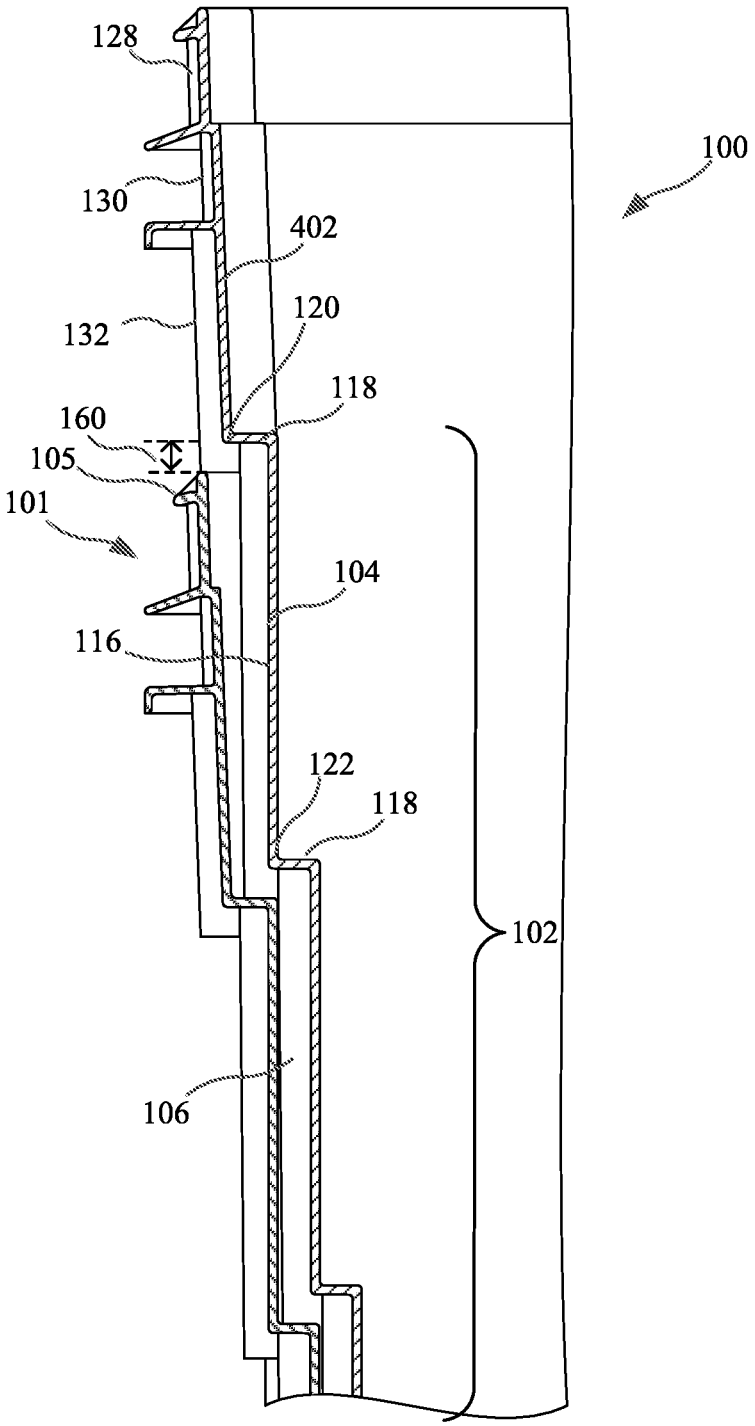
FIG. 6 is a cross-sectional view of two exemplary rectangular-shaped containers in a stacked configuration, according to one embodiment of the present disclosure.

Now turning to FIG. 6, a cross-sectional view of two exemplary rectangular-shaped containers 100 and 101 in a stacked configuration is shown, according to one embodiment of the present disclosure. In various embodiments, and as discussed above, rectangular-shaped containers 100 and 101 may include corner ribs 106 extending vertically along the portions of nestable structures 102, whereby the corner ribs 106 are staggered such that the corner ribs 106 mirror the surface of the nestable structures 102 to facilitate nesting. In particular embodiments, the corner rib 106 protrudes outwardly from the outer surface of nestable structure 102, whereby the corner rib 106 retains the step-like function of the nestable structures 102. In various embodiments, when rectangular-shaped containers 100 and 101 are in a stacked configuration, the corner rib overhang 160 of the interior-most container 100 rests on an interior step of the nestable structure 103 or rim 105 of the exterior-most container 101.

In the embodiment shown in FIG. 6, a corner rib 106 protrudes outwardly from the surface 116 of the nestable structure 102. In certain embodiments, and as discussed above, portions of the corner rib (e.g., corner rib portions 128 and 130) extend through the satellite ring assembly 107 and outwardly from the surface of the billboard (e.g., corner rib portion 132). In various embodiments, the bottom edge 122 and/or the top edge 120 of a nestable portion 104 of the nestable structure 102 form a corner or edge of an interior step 118 of the nestable structure 102.

Additional Exemplary Embodiments

The following discussion of FIGS. 7-21 includes descriptions of additional exemplary embodiments. These additional exemplary embodiments may include similar features of the exemplary embodiment discussed in FIGS. 1-6, with some variations. For example, the following additional exemplary embodiments may include corner or nestable structures, step-like interior features, corner ribs, and the like. For the purposes of brevity, not every feature that is common between the embodiments discussed in relation to FIGS. 1-6 and the embodiments discussed in relation to FIGS. 7-21 is discussed.

Figure 7:
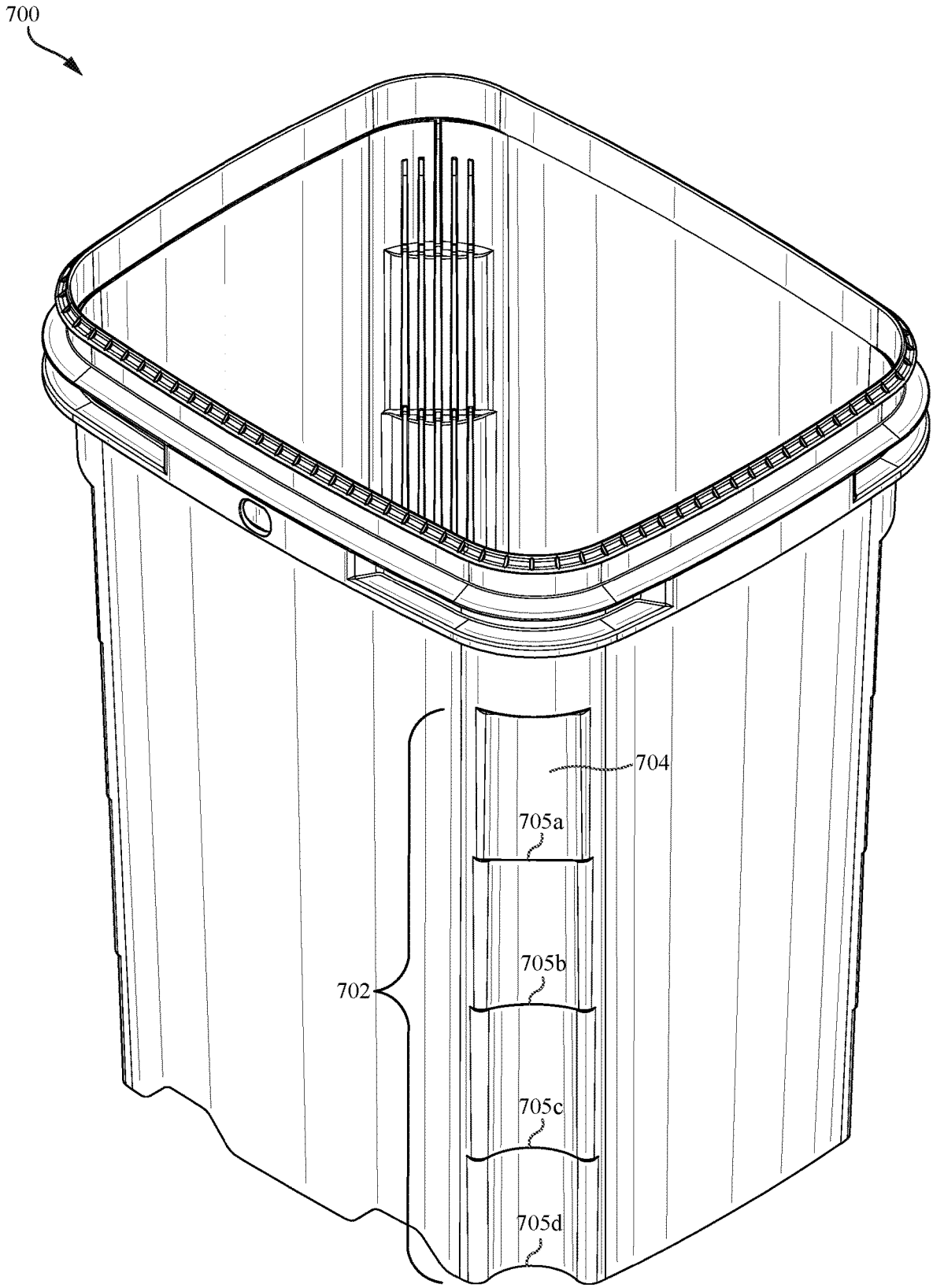
FIG. 7 is a perspective view of an exemplary rectangular-shaped container, according to one embodiment of the present disclosure.

FIG. 7 shows a perspective view of an exemplary rectangular-shaped container 700, according to one embodiment of the present disclosure. In various embodiments, the exemplary rectangular-shaped container 700 may include a nestable structure 702. In some embodiments, the nestable structure 702 includes one or more substantially rectangular portions 704. In certain embodiments, each portion 704 is substantially concave with respect to the sidewall of the container (e.g., includes a curved surface and top and/or bottom edges with a radius). In various embodiments, the one or more portions 704 may be staggered, in which each portion 704 has a progressively smaller radius 705 (e.g., 705*a*, 705*b*, 705*c*, and 705*d*), and a more circular "groove" (e.g., inward curvature), from a first portion (closer to the top of the container) to a last portion (closer to the bottom of the container). In at least one embodiment, the bottom edge of each portion 704 is substantially perpendicular to the outer sidewall (e.g., billboard) of the rectangular-shaped container 700. In various embodiments, the sides (e.g., edges) of each portion 704 include a sloped transition from the sidewall surface to a surface of the portion 704. In one or more embodiments, the top edge of each portion 704 forms includes a radius. In certain embodiments, a substantially semi-circular shape is formed on an interior of the container where the top of each portion 704 connects to the outer sidewall of the rectangular-shaped container 700. In certain embodiments, a nestable structure (e.g., nestable structure 702) may be included on any or all corners of the rectangular-shaped container 700.

Figure 8:
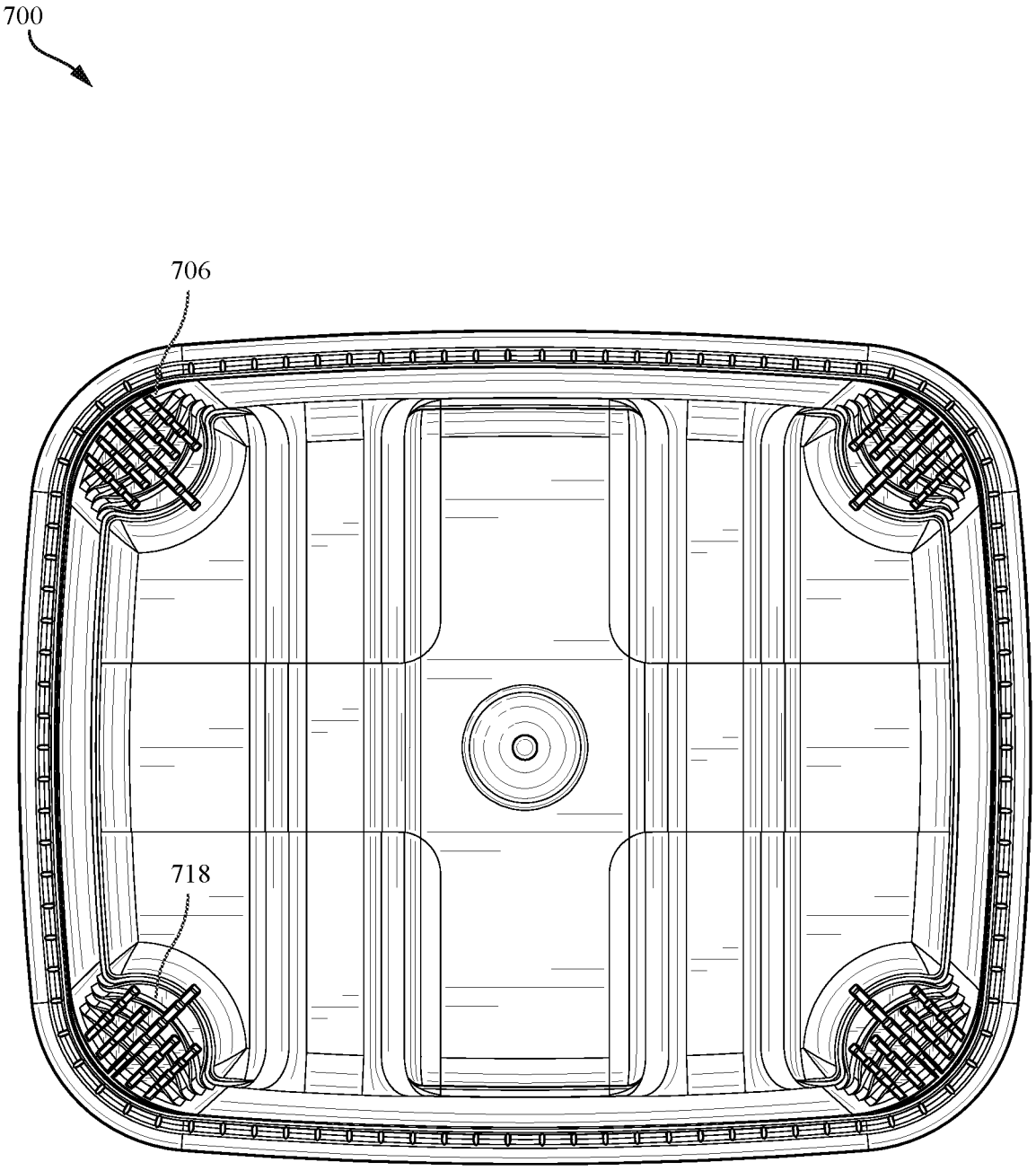
FIG. 8 is a top view of an exemplary rectangular-shaped container, according to one embodiment of the present disclosure.

Now referring to FIG. 8, a top view of an exemplary rectangular-shaped container 700 is shown, according to one embodiment of the present disclosure. In some embodiments, the top edge of each portion (e.g., interior step 718) is substantially parallel to the bottom surface of the rectangular-shaped container 700. In particular embodiments, and as shown in FIG. 8, multiple corner ribs 706 may be included on the inside of the container, extending vertically along portions and various surfaces of the nestable structure to increase the strength and structural integrity of the rectangular-shaped container 700. In one embodiment, the corner ribs 706 may be included on the outside of the container. In another embodiment, the corner ribs 706 may be included on the inside of the container. In yet another embodiment, the corner ribs 706 may be included on both the outside and inside of the container. In particular embodiments, and as shown in FIG. 8, the corner ribs 706 extend the entire length of the rectangular-shaped container 700. In various embodiments, the length of the corner ribs 706 may vary, such that load support and stability may be optimized. In one or more embodiments, the rectangular-shaped container may include a single corner rib 706 on the inside and/or the outside of the container.

In certain embodiments, an interior step 718 is formed where the bottom edge of each portion 704 connects to the outer sidewall of the rectangular-shaped container 700. In at least one embodiment, the interior step 718 is substantially semi-circular. In certain embodiments, the radii of the surface of each interior step 718 gets progressively smaller as the steps get closer to the bottom surface of the container.

Figure 9:
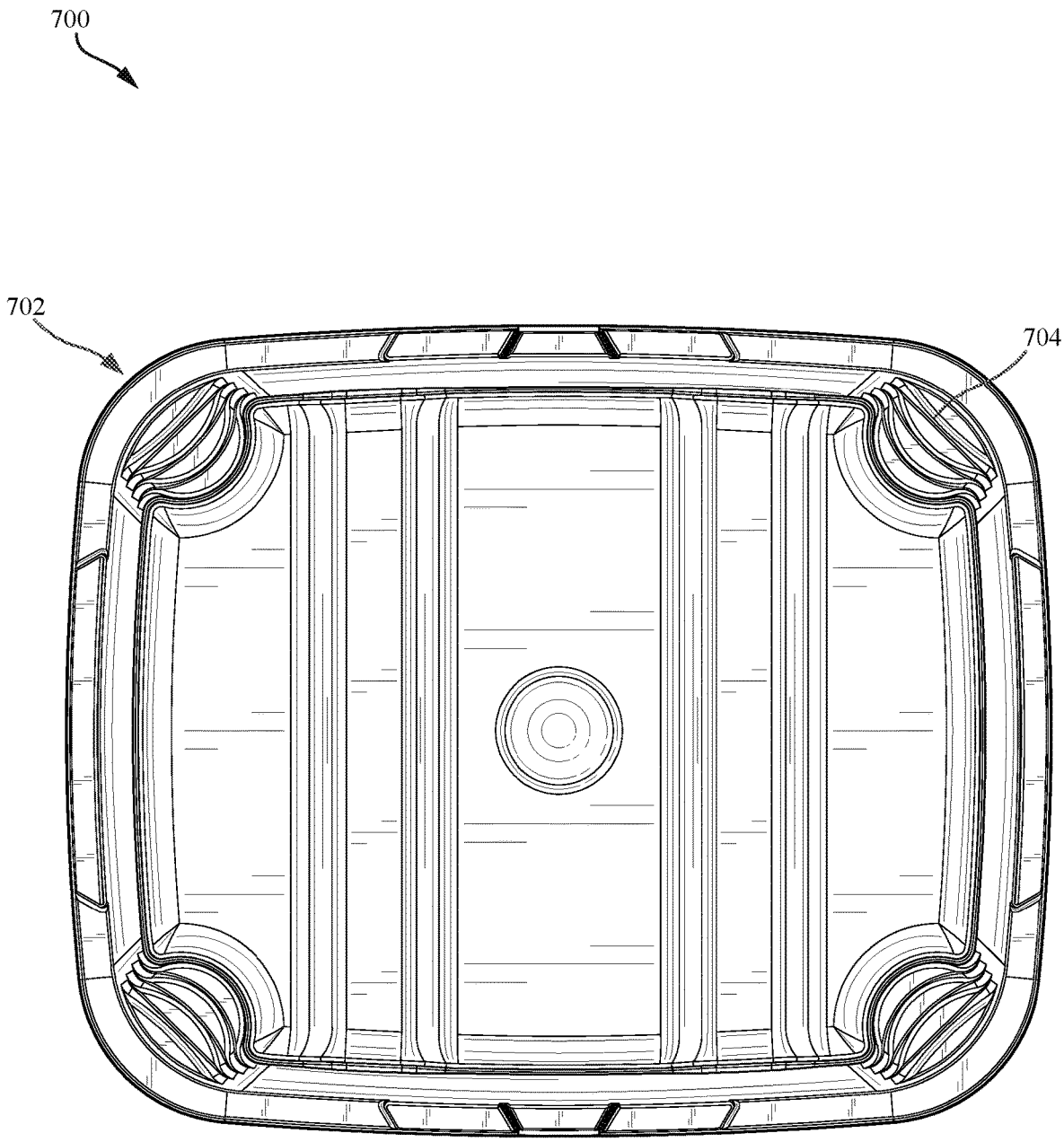
FIG. 9 is a bottom view of an exemplary rectangular-shaped container, according to one embodiment of the present disclosure.

FIG. 9 shows a bottom view of an exemplary rectangular-shaped container 700, according to one embodiment of the present disclosure. In certain embodiments, the exemplary rectangular-shaped container 700 includes a nestable structure 702 that includes a series of nestable portions 704 that are generally curved inwardly (e.g., concave). In particular embodiments, and as shown in FIG. 9, the radius of each portion 704 is progressively smaller than the portion 704 above it. In certain embodiments, the surface area of each step-like surface of each portion is progressively larger than the step above it. In at least one embodiment, the bottom-most portion 704 is more circular in shape than the top-most portion 704. In one or more embodiments, the nestable portions 704 may form a series of internal shelves that facilitate nesting. In various embodiments, the nestable portions 704 (and steps thereof) may be staggered to facilitate nesting at lower height than traditional containers because an interior container in a stacking configuration may rest on the lowest portion of the nestable structure 702 of an exterior container in the stacking configuration. In particular embodiments, the nestable structure 702 may be included on one or more sides of the rectangular-shaped container 700.

Figure 10:
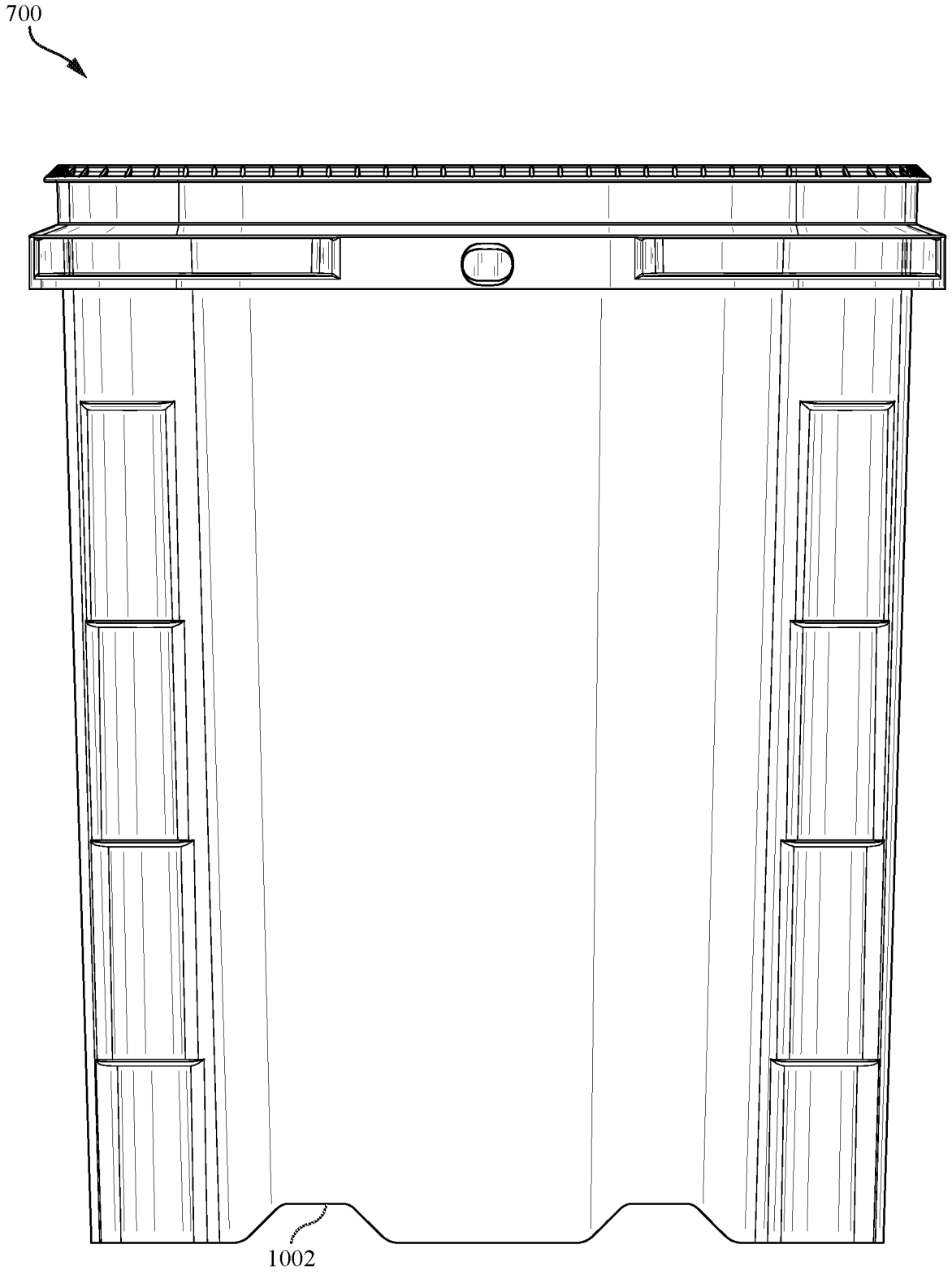
FIG. 10 is a side view of an exemplary rectangular-shaped container, according to one embodiment of the present disclosure.

Turning now to FIG. 10, a side view of an exemplary rectangular-shaped container 700 is shown, according to one embodiment of the present disclosure. In various embodiments, the exemplary rectangular-shaped container 700 includes indented grooves 1002 at the bottom of the container to provide a stable base for the container when the container is laid to rest on a surface. In at least one embodiment, the rectangular-shaped container 700 includes two indented grooves 1002. In various embodiments, the rectangular shaped container 700 may include more or less than two indented grooves 1002 (e.g., one indented groove, four indented grooves, etc.). In particular embodiments, the indented grooves 1002 extend from one wall of the container bottom to the opposite wall of the container bottom.

Figure 11:
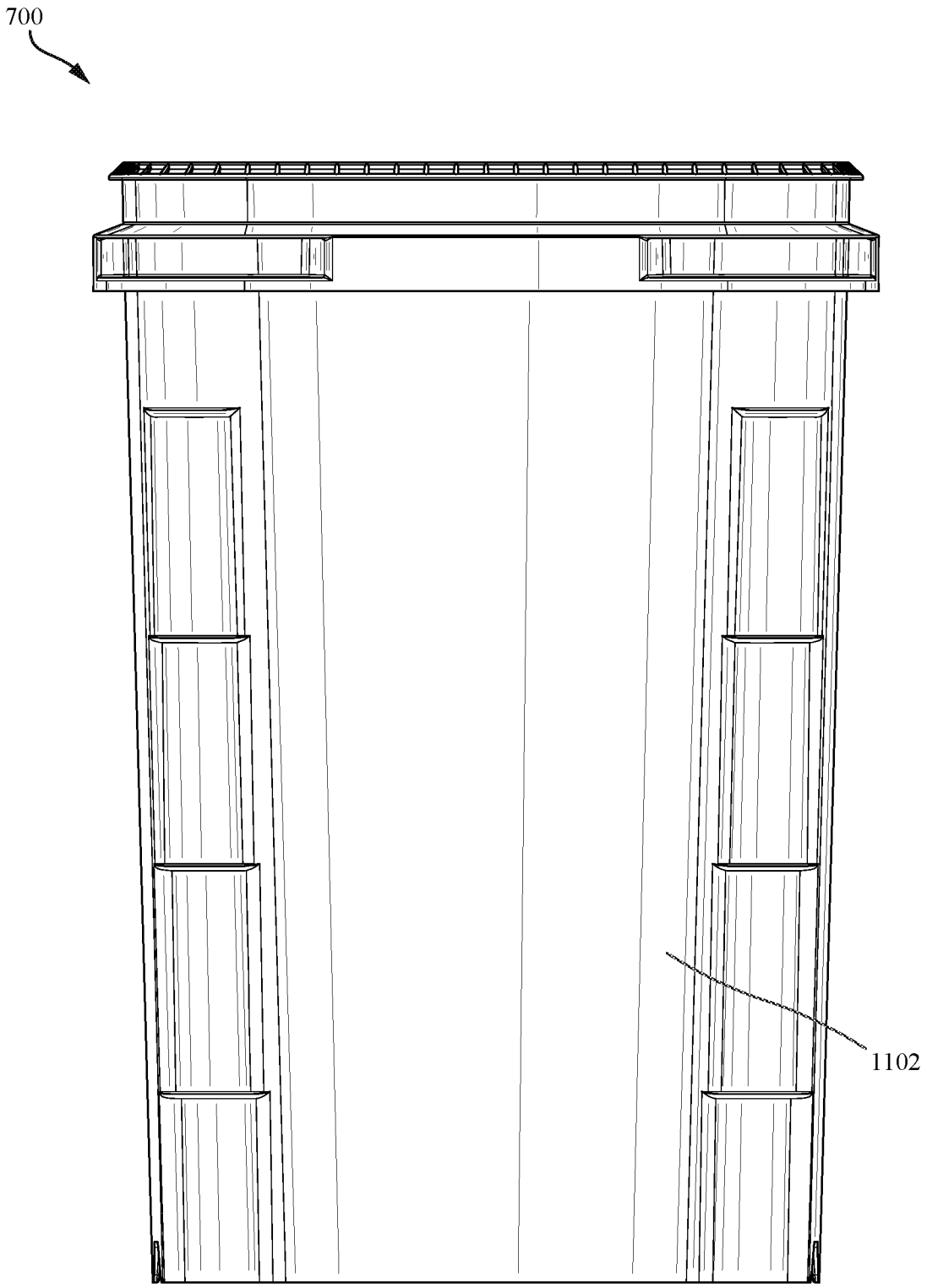
FIG. 11 is a side view of an exemplary rectangular-shaped container, according to one embodiment of the present disclosure.

FIG. 11 shows a side view of an exemplary rectangular-shaped container 700, according to one embodiment of the present disclosure. In one or more embodiments, the exemplary rectangular-shaped container 700 includes a billboard (e.g., sidewall) 1102 on all four sides to enclose the rectangular-shaped container 700 and provide a solid base for stability. In some embodiments, the billboard 1102 may be larger than on traditional containers because less satellite rings are included in these embodiments (and others) than on traditional containers. In some embodiments, the billboard 1102 may include graphical information (e.g., signage).

Figure 12:
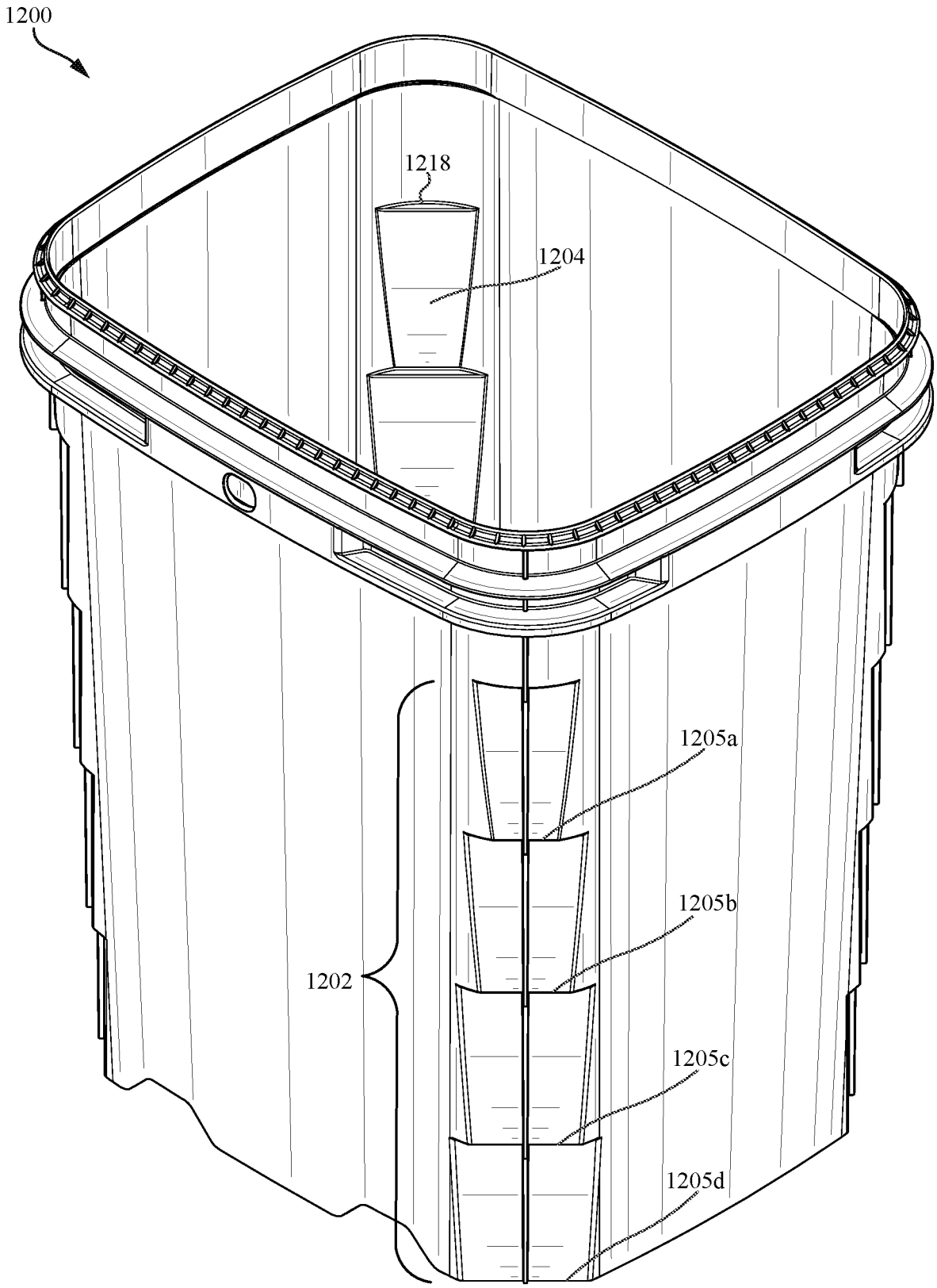
FIG. 12 is a perspective view of an exemplary rectangular-shaped container, according to one embodiment of the present disclosure.

FIG. 12 shows a perspective view of an exemplary rectangular-shaped container 1200, according to one embodiment of the present disclosure. In particular embodiments, the exemplary rectangular-shaped container 1200 may include one or more substantially trapezoidal-shaped portions 1204 that form a staggered structure. In at least one embodiment, the width 1205 (e.g., 1205*a*, 1205*b*, 1205*c*, and 1205*d*) between the sides (e.g., edges) of each portion 1204 gets progressively smaller from the top of the portion 1204 to the bottom of the portion 1204. In particular embodiments, the flat section (e.g., interior step 1218) of the portions 1204 parallel to the bottom of the container get progressively larger and the "slopes" (e.g., the ratio between the width at the top of a portion and the width at the bottom of the portion) are progressively less steep from the top of the container to the bottom of the container. In at least one embodiment, the top of each portion 1204 is substantially parallel to the outer sidewall (e.g., billboard) of the rectangular-shaped container 1200. In certain embodiments, a nestable structure (e.g., nestable structure 1202) may be included on any or all corners of the rectangular-shaped container 1200.

Figure 13:
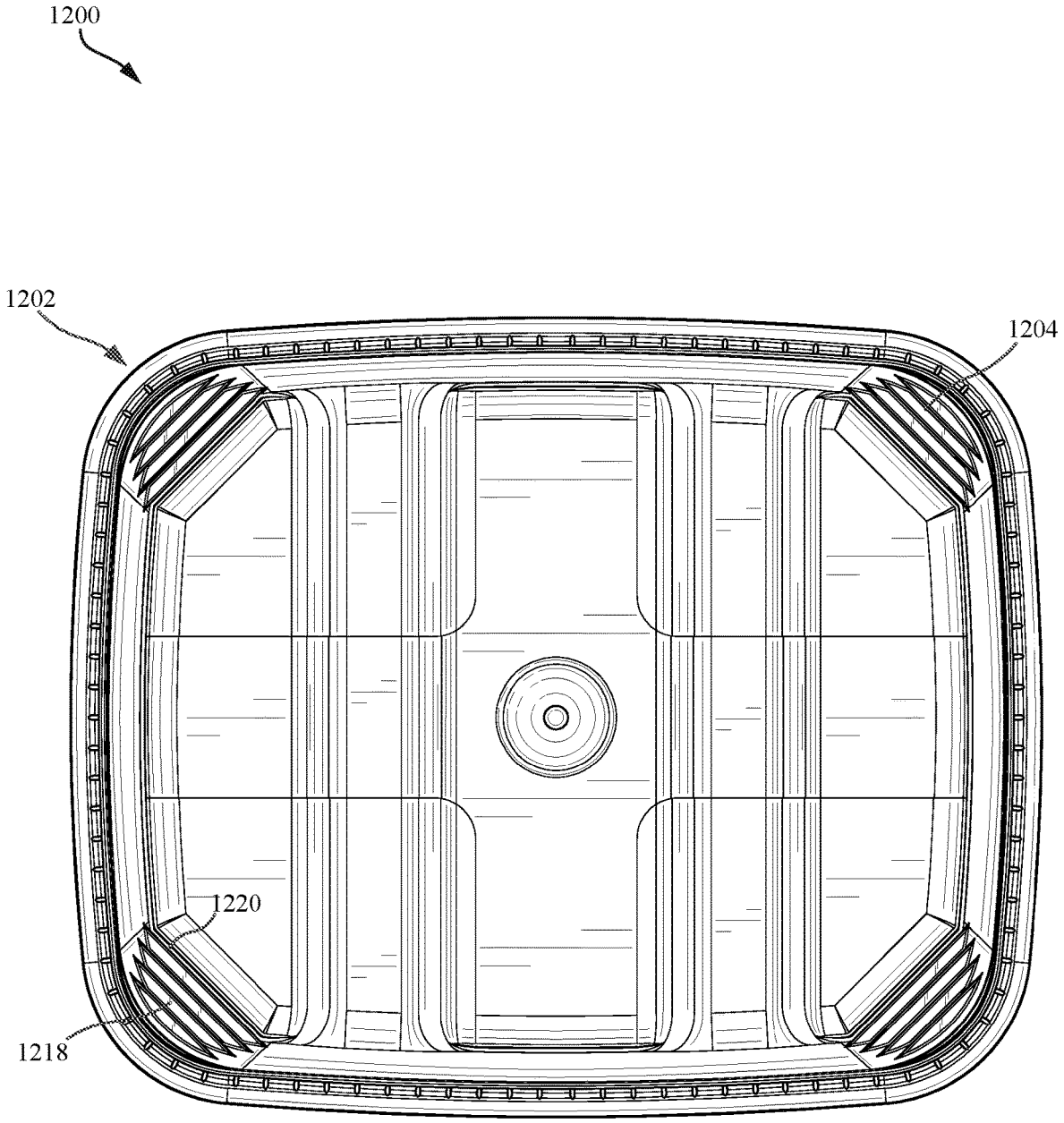
FIG. 13 is a top view of an exemplary rectangular-shaped container, according to one embodiment of the present disclosure.

Referring now to FIG. 13, a top view of an exemplary rectangular-shaped container 1200 is shown, according to one embodiment of the present disclosure. In certain embodiments, the exemplary rectangular-shaped container 1200 includes a nestable structure 1202 that includes a series of nestable, trapezoidal-shaped portions 1204 that protrude inwardly. In one or more embodiments, the nestable portions 1204 may form a series of internal shelves (e.g., interior steps 1218) that facilitate nesting. In various embodiments, the nestable portions 1204 may be staggered to facilitate nesting at lower height than traditional containers because an interior container in a stacking configuration may rest on the lowest portion of the nestable structure 1202 of an exterior container in the stacking configuration. In particular embodiments, the nestable structure 1202 may be included on one or more sides of the rectangular-shaped container 1200.

In certain embodiments, the container includes an interior step 1218 (one or more interior steps). In at least one embodiment, the interior step 1218 is substantially trapezoidal. In certain embodiments, the top edge 1220 of each interior step 1218 gets progressively larger as the steps get closer to the bottom surface of the container.

Figure 14:
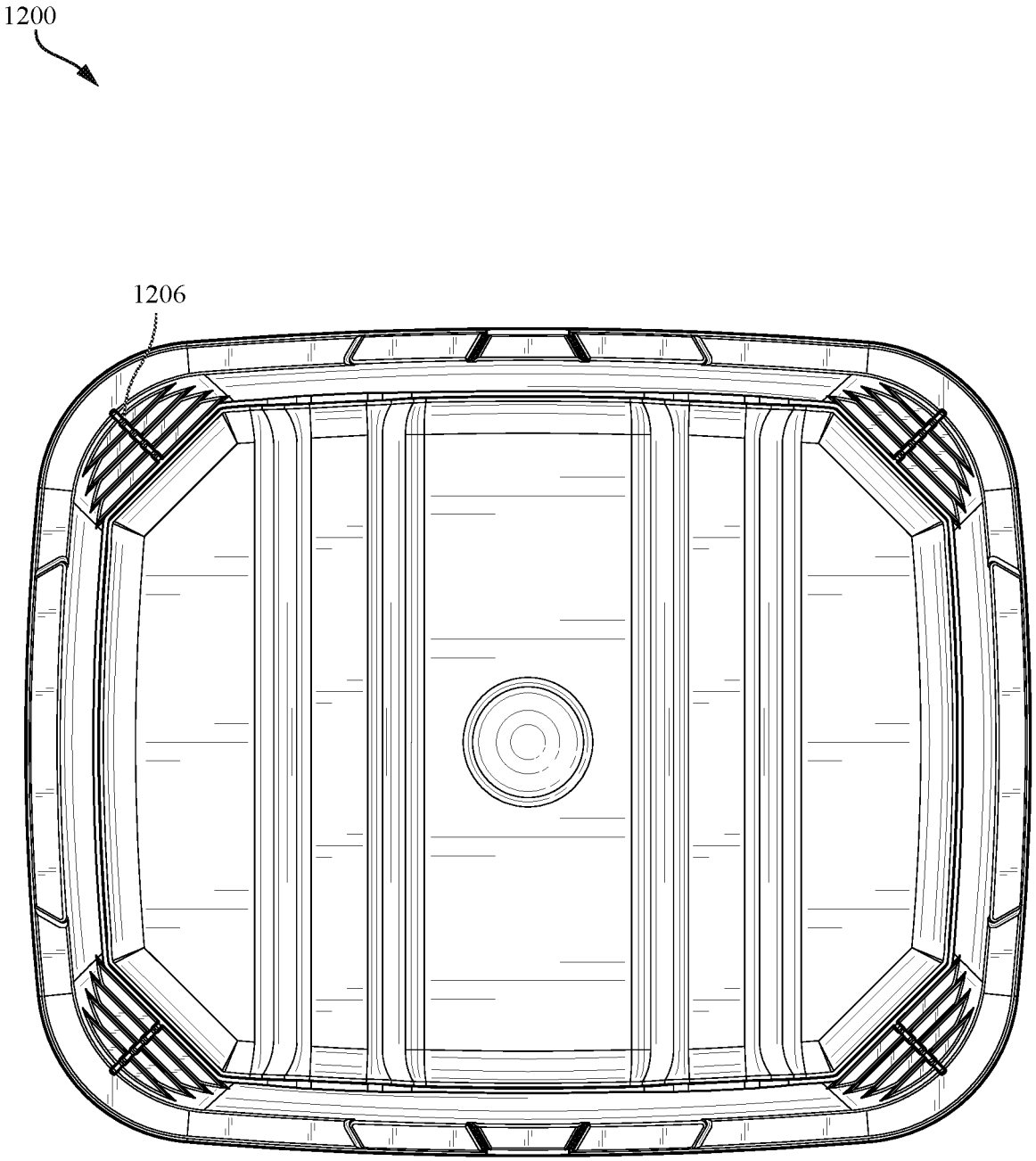
FIG. 14 is a bottom view of an exemplary rectangular-shaped container, according to one embodiment of the present disclosure.

FIG. 14 shows a bottom view of an exemplary rectangular-shaped container 1200, according to one embodiment of the present disclosure. In particular embodiments, and as shown in FIG. 14, a single corner rib 1206 may be included on the outside of the container, extending vertically along the portions of the nestable structure to increase the strength and structural integrity of the rectangular-shaped container 1200. In one embodiment, the corner rib 1206 may be included on the outside of the container. In another embodiment, the corner rib 1206 may be included on the inside of the container. In yet another embodiment, the corner rib 1206 may be included on both the outside and inside of the container. In particular embodiments, and as shown in FIG. 14, the corner rib 1206 extends along the surface of the nestable structure of the rectangular shaped container 1200. In various embodiments, the length of the corner rib 1206 may vary, such that load support and stability may be optimized. In one or more embodiments, the rectangular-shaped container 1200 may include multiple corner ribs 1206 on the inside and/or the outside of the container.

Figure 15:
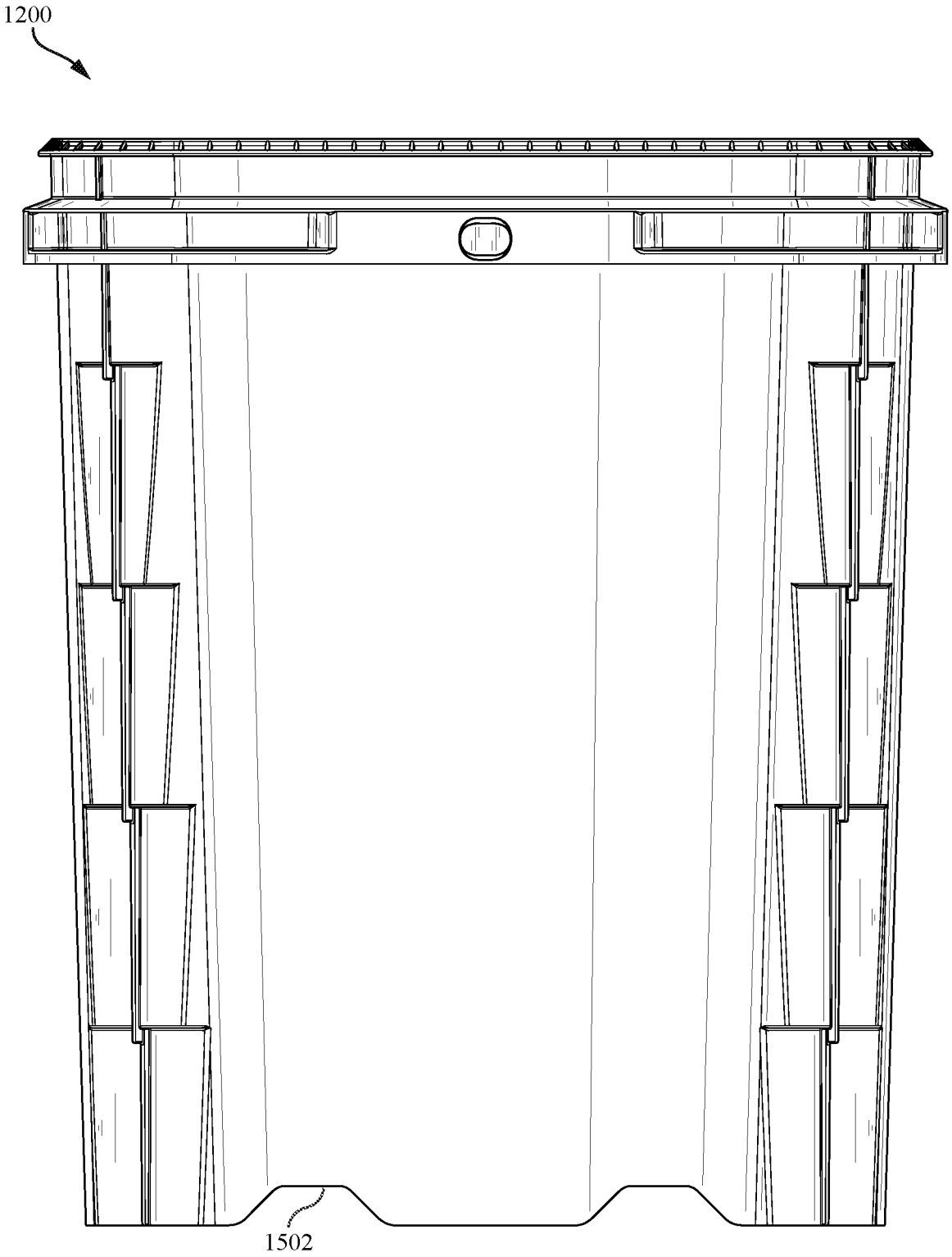
FIG. 15 is a side view of an exemplary rectangular-shaped container, according to one embodiment of the present disclosure.

FIG. 15 shows a side view of an exemplary rectangular-shaped container 1200, according to one embodiment of the present disclosure. In various embodiments, the exemplary rectangular-shaped container 1200 includes indented grooves 1502 at the bottom of the container to provide a stable base for the container when the container is laid to rest on a surface. In at least one embodiment, the rectangular-shaped container 1200 includes two indented grooves 1502. In various embodiments, the rectangular shaped container 1200 may include more or less than two indented grooves 1502 (e.g., one indented groove, four indented grooves, etc.). In particular embodiments, the indented grooves 1502 extend from one wall of the container bottom to the opposite wall of the container bottom.

Figure 16:
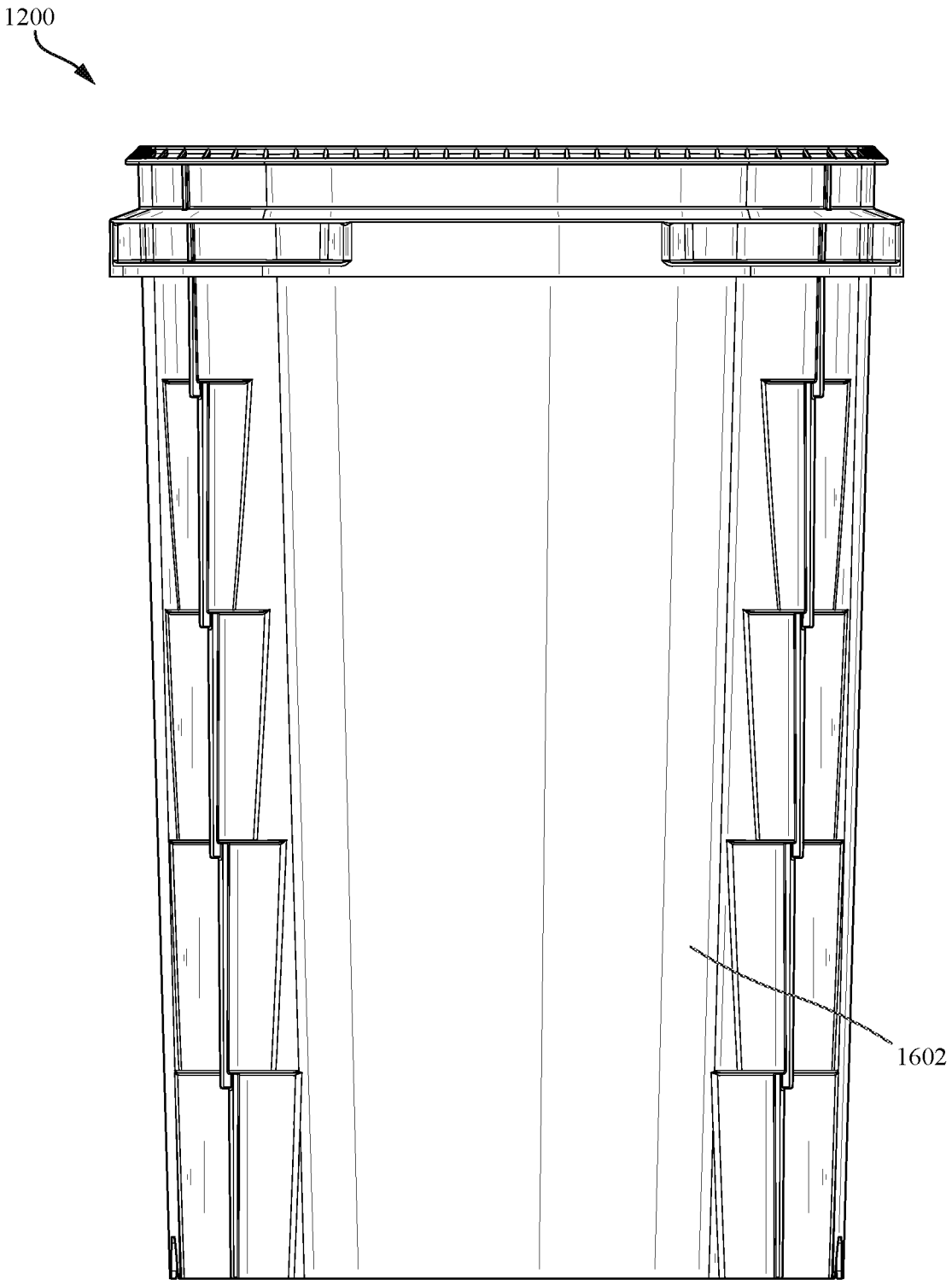
FIG. 16 is a side view of an exemplary rectangular-shaped container, according to one embodiment of the present disclosure.

Now referring to FIG. 16, a side view of an exemplary rectangular-shaped container 1200 is shown, according to one embodiment of the present disclosure. In one or more embodiments, the exemplary rectangular-shaped container 1200 includes a billboard (e.g., sidewall) 1602 on all four sides to enclose the rectangular-shaped container 1200 and provide a solid base for stability. In some embodiments, the billboard 1602 may be larger than on traditional containers because less satellite rings are included in these embodiments (and others) than on traditional containers. In some embodiments, the billboard 1602 may include graphical information (e.g., signage).

Figure 17:
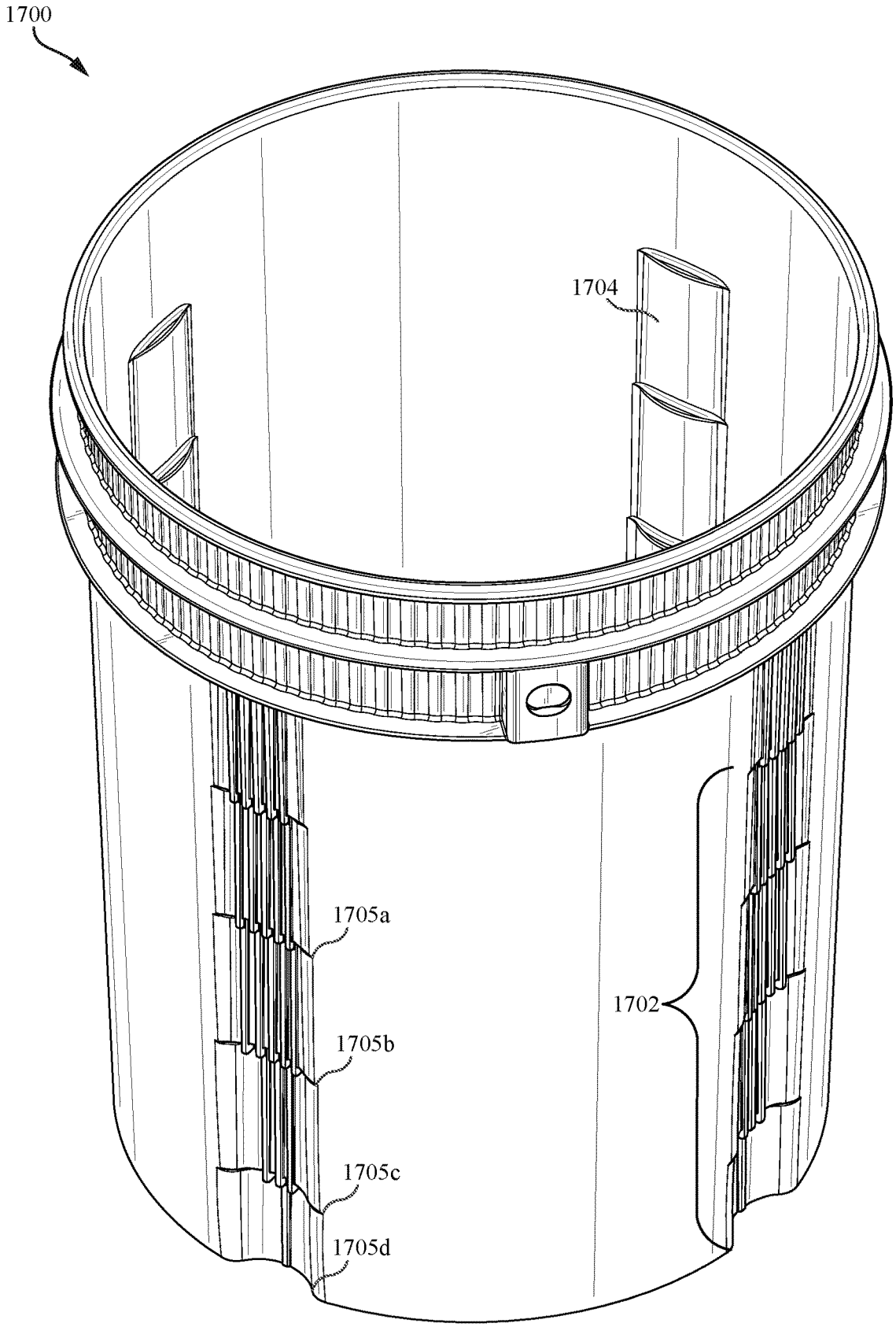
FIG. 17 is a perspective view of an exemplary circular-shaped container, according to one embodiment of the present disclosure.

FIG. 17 shows a perspective view of an exemplary circular-shaped container 1700, according to one embodiment of the present disclosure. In one or more embodiments, the exemplary circular-shaped container 1700 may include a nestable structure 1702 containing a series of nestable portions 1704 to facilitate container nesting. In certain embodiments, each portion has a substantially rectangular surface area. In particular embodiments, each portion is of a substantially concave shape (e.g., includes a radius) with respect to the sidewall of the container. In certain embodiments, each portion 1704 has a progressively smaller radius 1705 (e.g., 1705*a*, 1705*b*, 1705*c*, and 1705*d*), and a more circular "groove" (e.g., inward curvature), from a first portion (closest to the top of the container) to a last portion (closer to the bottom of the container). In at least one embodiment, the bottom of each portion 1704 is substantially perpendicular to the outer sidewall (e.g., billboard) of the circular-shaped container 1700. In various embodiments, the sides (e.g., edges) of each portion 1704 transition from the sidewall to a surface of the nestable structure. In one or more embodiments, the top of each portion 1704 includes a curved surface and top and/or bottom edges with a radius. In certain embodiments, a substantially semi-circular shape is formed where the top of each portion 1704 connects to the outer sidewall of the circular-shaped container 1700. The staggered nature of the portions 1704 may provide for additional strength while using less material than traditional containers, and may also facilitate nesting at a lower height than traditional containers. In some embodiments, the nestable structure 1702 may be included at one or more sections of the circular-shaped container 1700. In particular embodiments, the one or more sections of the nestable structure may be equidistant apart. In particular embodiments, the distance between the top edge of the top portion 1704 of the nestable structure 1702 and the bottom edge of the bottom portion 1704 of the nestable structure 1702 is substantially similar on each nestable structure 1702 of the circular-shaped container.

Figure 18:
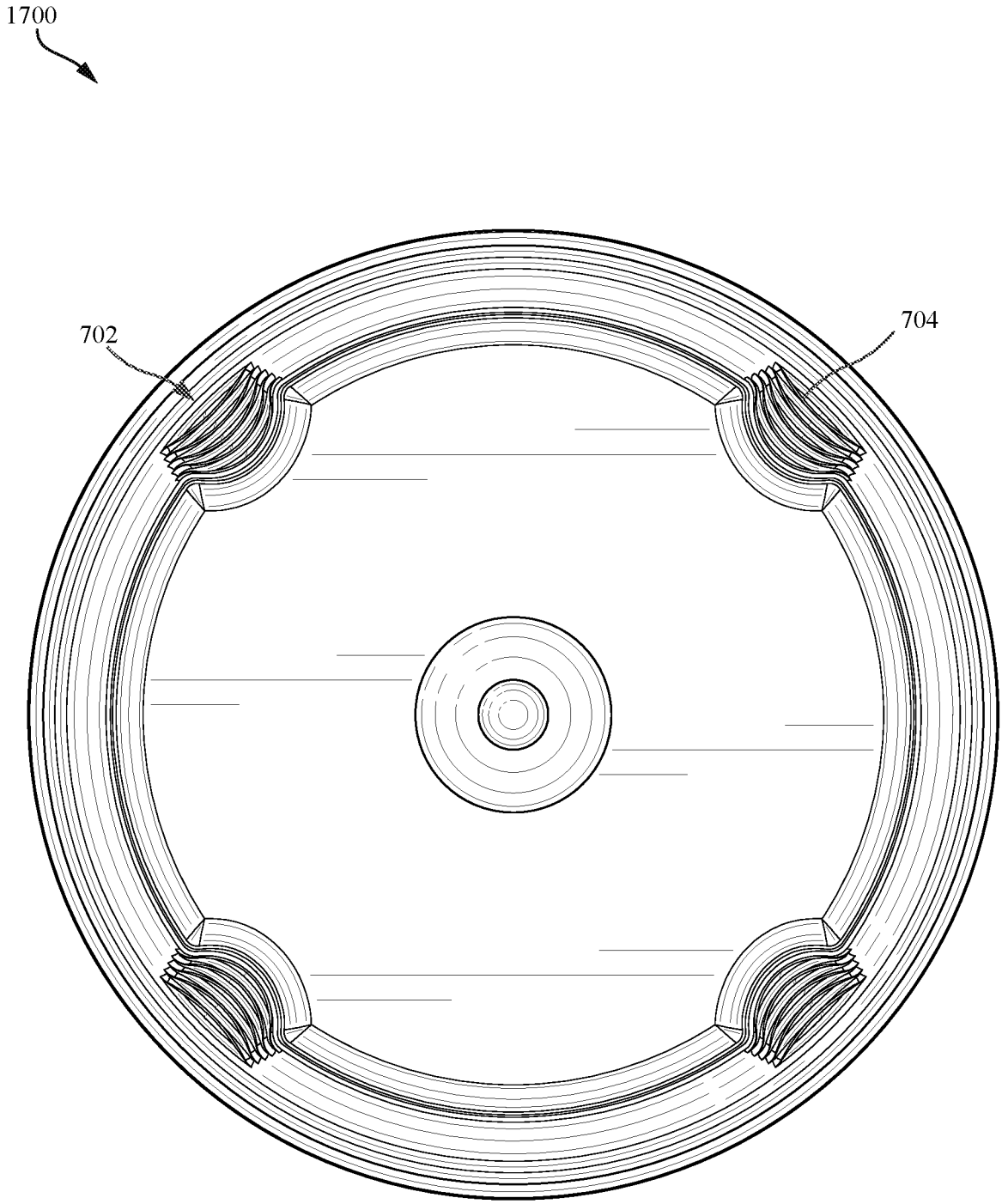
FIG. 18 is a top view of an exemplary circular-shaped container, according to one embodiment of the present disclosure.

Turning now to FIG. 18, a top view of an exemplary circular-shaped container 1700 is shown, according to one embodiment of the present disclosure. In some embodiments, as discussed above, the exemplary circular-shaped container 1700 includes a nestable structure 1702 that includes a series of nestable portions 1704 that are curved inwardly (e.g., concave). In one or more embodiments, the nestable portions 1704 may form a series of internal shelves or steps that facilitate nesting. In some embodiments, the top surface of each portion is substantially parallel to the bottom surface of the circular-shaped container 1700. In various embodiments, the nestable portions 1704 may be staggered to facilitate nesting at lower height than traditional containers because an interior container in a stacking configuration may rest on the lowest portion of the nestable structure 1702 of an exterior container in the stacking configuration. In particular embodiments, the nestable structure 1702 may be included on one or more sides of the circular-shaped container 1700.

Figure 19:
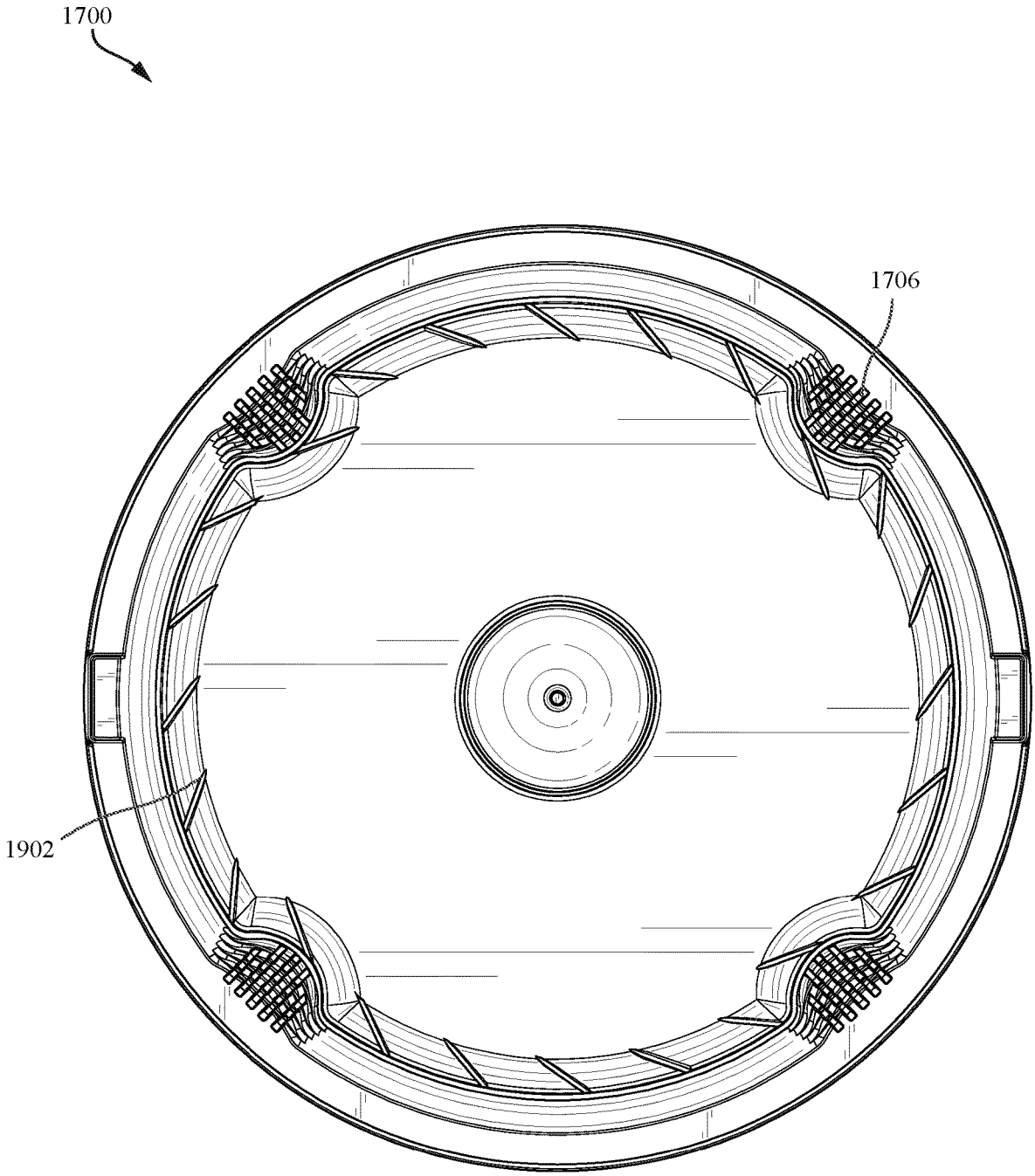
FIG. 19 is a bottom view of an exemplary circular-shaped container, according to one embodiment of the present disclosure.

FIG. 19 is a bottom view of an exemplary circular-shaped container 1700, according to one embodiment of the present disclosure. In particular embodiments, and as shown in FIG. 19, multiple ribs 1706 may be included on the inside of the container, extending vertically along the portions of the nestable structure to increase the strength and structural integrity of the circular-shaped container 1700. In particular embodiments, the ribs 1706 may be staggered in accordance with the nestable structure, so as not to function as an impediment when containers are nested. In one embodiment, the ribs 1706 may be included on the outside of the container. In another embodiment, the ribs 1706 may be included on the inside of the container. In yet another embodiment, the ribs 1706 may be included on both the outside and inside of the container. In particular embodiments, and as shown in FIG. 19, the ribs 1706 extend the entire length of the circular-shaped container 1700. In various embodiments, the length of the ribs 1706 may vary, such that load support and stability may be optimized (e.g., the ribs 1706 may extend a portion of the length of the container). In one or more embodiments, the circular-shaped container 1700 may include a single rib 1706 on the inside and/or the outside of the container. In various embodiments, the circular-shaped container 1700 includes one or more chimes 1902 to facilitate protection of the circular-shaped container 1700 when handled, and stability when in a stacked configuration.

Figure 20:
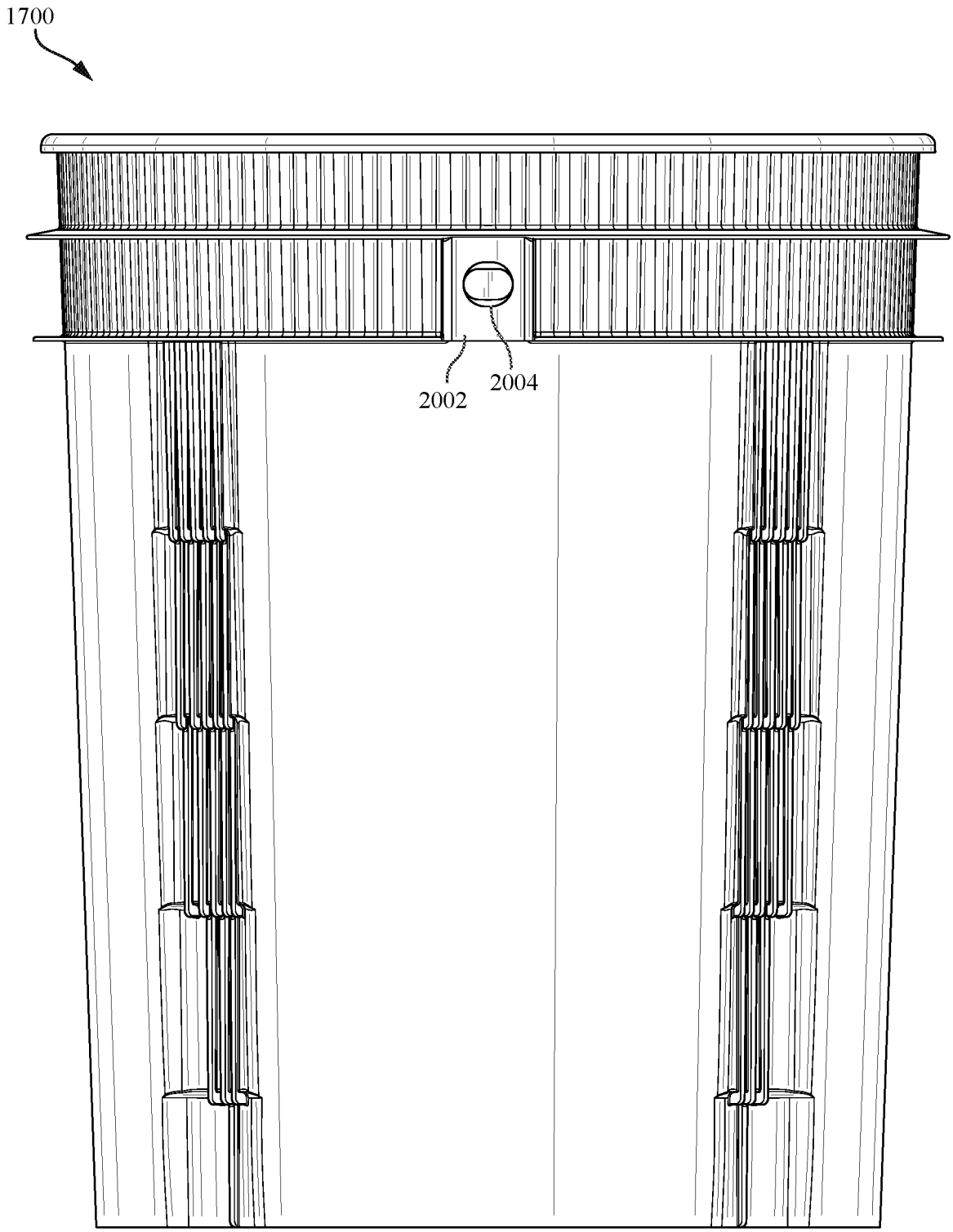
FIG. 20 is a side view of an exemplary circular-shaped container, according to one embodiment of the present disclosure.
Figure 21:
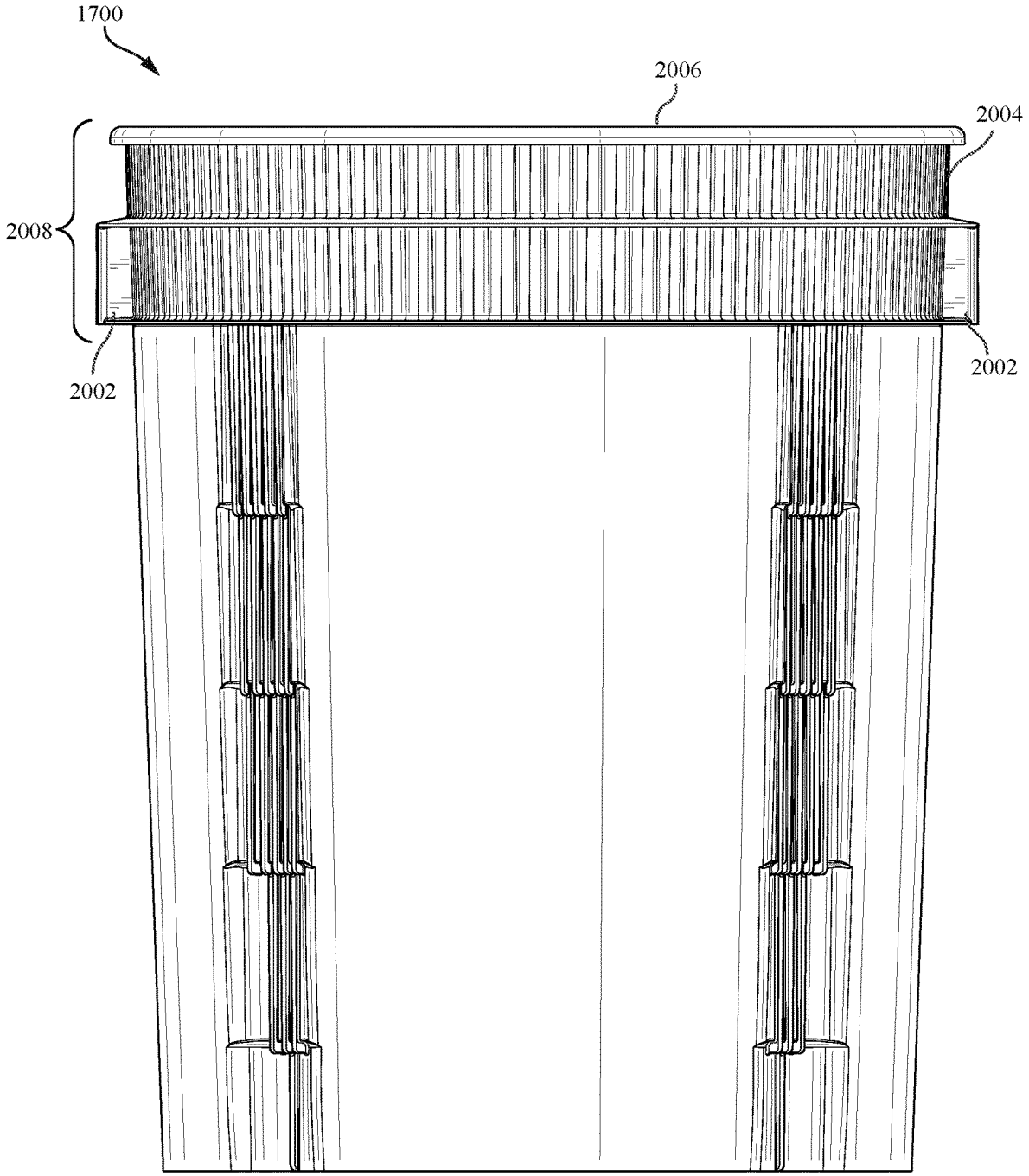
FIG. 21 is a side view of an exemplary circular-shaped container, according to one embodiment of the present disclosure.

FIGS. 20 and 21 are side views of an exemplary circular-shaped container 1700, according to one embodiment of the present disclosure. In particular embodiments, the circular-shaped container 1700 includes bail cars 2002 on opposite side walls of the exterior of the circular-shaped container 1700. In one or more embodiments, the bail cars 2002 may be located on the upper portion of the exterior of the circular-shaped container 1700 within a satellite ring assembly. In various embodiments, each bail car 2002 includes a provision for a handle attachment 2004 to facilitate carrying the container. In one or more embodiments, the provision for a handle attachment 2004 includes an opening or depression of varying shapes and sizes that allows for the attachment of a handle that can be used for carrying the circular-shaped container 1700.

In particular embodiments, the circular-shaped container 1700 includes corrugated side walls 2004 for additional strength and stability. In one or more embodiments, the corrugated side walls 2004 extend around and along the upper portion 2008 of the circular-shaped container 1700. In certain embodiments, the corrugated side walls 2004 extend from the bottom of the bail ears 2002 up to the container rim 2006.

Alternate Embodiments

Alternative embodiments of the container described herein may include features that are, in some respects, similar to the various components described above, and may include, but are not limited to: corner ribs, billboards, container beads, satellite rings, provisions for handle attachments, handles, hand grips, indented grooves, rims, etc. In particular embodiments, multiple ribs may be included on the outside of the circular-shaped container, extending vertically along the nestable structure. In various embodiments, the multiple ribs may be included on the inside of the circular-shaped container, or on both the inside and outside of the circular-shaped container. In one or more embodiments, the multiple ribs may be included on any or all sections of the circular-shaped container. In particular embodiments, only one rib may be included on any or all sections of the circular-shaped container.

In various embodiments, a container with nestable structure may include alternating ribs per container (e.g., to prevent collisions between ribs when multiple containers are stacked or nested together). In some embodiments, the length of each "portion" (e.g., the distance between the top of the portion and the bottom of the portion along the sidewall of the container within the nestable structure may vary (e.g., the first portion may be longer than the last portion, the second portion may be shorter than the first portion, etc.). In one or more embodiments, the nestable structure may occupy any vertical length of a container, which may or may not be a corner.

Additionally, in particular embodiments, various permutations of the above described features may be included. For example, in one embodiment, the slope structure may be combined with the groove structure, whereby the portions may be both trapezoidal (as shown in FIG. 12) and substantially concave in shape (as shown in FIG. 7). In another embodiment, the groove structure may be combined with the radius structure, whereby the portions may be substantially concave while including a substantially similar radius as each preceding portion (as shown in FIG. 1). In yet another embodiment, the radius structure may be combined with the slope structure, in which the portions are trapezoidal in shape and whereby each portion includes a substantially similar radius as the preceding portion. In still another embodiment, the groove structure may be combined with both the radius structure and the slope structure. In these embodiments (and others), the portions may vary whereby some portions include a substantially similar radius as the preceding portion, some portions are trapezoidal in shape, some portions are substantially convex in shape, and some portions are substantially concave in shape.

CONCLUSION

Accordingly, it will be readily understood by those persons skilled in the art that, in view of the above detailed description of the various embodiments and articles of the present disclosure, the present disclosure is susceptible of broad utility and application. Many methods, embodiments, and adaptations of the present disclosure other than those herein described, as well as many variations, modifications, and equivalent arrangements will be apparent from or reasonably suggested by the present disclosure and the above detailed description thereof, without departing from the substance or scope of the present disclosure. Accordingly, while the present disclosure is described herein in detail in relation to various embodiments, it is to be understood that this detailed description is only illustrative and exemplary of the present disclosure and is made for purposes of providing a full and enabling disclosure of the present disclosure. The detailed description set forth herein is not intended nor is to be construed to limit the present disclosure or otherwise to exclude any such other embodiments, adaptations, variations, modifications, and equivalent arrangements of the present disclosure. The scope of the present disclosure is defined solely by the claims appended hereto and the equivalents thereof.

The invention claimed is:

1. A container comprising:

a top comprising a top perimeter;

a bottom comprising a bottom surface and a bottom perimeter, the bottom perimeter;

a sidewall surface extending upwardly from the bottom perimeter to the top perimeter, the sidewall surface being located on an exterior of the container and being substantially smooth; and a strengthening structure extending from the bottom perimeter to an upper portion of the container and comprising:

a first side edge along a first side of the strengthening structure, the first side edge being substantially parallel to the sidewall surface;

a second side edge along a second side of the strengthening structure, the second side edge being substantially parallel to the sidewall surface;

a first step surface extending from the sidewall surface inwardly to a first strengthening structure surface, the first step surface being substantially parallel to the bottom surface;

a second step surface extending from the first strengthening structure surface inwardly to a second strengthening structure surface, the second step surface being substantially parallel to the bottom surface; and one or more ribs extending along an external surface of the strengthening structure, wherein one of the one or more ribs (i) extends vertically between the first step surface and the second step surface and (ii) comprises a rib overhang that extends to a lowermost height that is less than a height of the first step surface and a height of the second step surface, wherein all heights are determined relative to the bottom surface of the bottom of the container.

2. The container of claim 1 further comprising one or more interior ribs located on an interior surface of the strengthening structure and within an interior of the container.

3. The container of claim 1, wherein the strengthening structure further comprises one or more additional strengthening structure surfaces along the first side edge and the second side edge.

4. The container of claim 3, wherein a distance between the first side edge and second side edge is constant along the strengthening structure.

5. The container of claim 3, wherein a distance between the first side edge and second side edge varies along the strengthening structure.

6. The container of claim 1, wherein the bottom perimeter has a shape comprising four sides, each of the four sides being substantially straight.

7. The container of claim 1, wherein the bottom perimeter has a substantially circular shape.

8. The container of claim 1, wherein:

the upper portion of the container comprises at least two satellite rings located along an exterior perimeter of the upper portion, and the one of the one or more ribs extends vertically between the at least two satellite rings.

9. The container of claim 8, wherein the one of the one or more ribs extends vertically between an uppermost satellite ring of the at least two satellite rings and a rim structure located along the top perimeter.

10. The container of claim 1, wherein:

the strengthening structure is a first strengthening structure, the container further comprises a second strengthening structure, and the sidewall surface extends from an edge of the first strengthening structure to an edge of the second strengthening structure.

11. The container of claim 10, wherein the sidewall surface is substantially flat.

12. The container of claim 10, wherein the sidewall surface is substantially convex.

13. A container comprising:

an interior bottom perimeter;

a top container edge;

a first sidewall section extending from the interior bottom perimeter to the top container edge, the first sidewall section having an exterior surface that is substantially smooth;

a second sidewall section extending from the interior bottom perimeter to the top container edge; and a sidewall structure comprising two or more steps, the sidewall structure being disposed between the first sidewall section and the second sidewall section, each of the two or more steps comprising:

a first step surface extending from a first internal edge to a first external edge, the first step surface having a first uppermost height and a first lowermost height; and a second step surface extending from a second internal edge to second external edge, the second step surface having a second uppermost height and a second lowermost height that are less than the first uppermost height and the first lowermost height, wherein all heights are determined relative to the interior bottom perimeter; and one or more ribs extending vertically along an external surface of the sidewall structure, wherein one of the one or more ribs extends vertically from a location above one of the first or second step surfaces to a lowermost rib height that is less than the first lowermost height or the second lowermost height such that the one of the one or more ribs comprises a rib overhang across the first external edge or the second external edge.

14. The container of claim 13, wherein:

the first step surface extends a first distance from the first sidewall section to the second sidewall section; and the second step surface extends a second distance from the first sidewall section to the second sidewall section, the second distance being different from the first distance.

15. The container of claim 13, wherein the first external edge of the first step surface comprises a first radius and the second external edge of the second step surface comprises a second radius that is equal to the first radius.

16. The container of claim 13, wherein the interior bottom perimeter is substantially rectangular.

17. The container of claim 13, wherein the interior bottom perimeter is substantially circular.

18. The container of claim 13, wherein each of the two or more steps is recessed inward toward an interior of the container, relative to the first sidewall section and the second sidewall section.

19. The container of claim 18, wherein:

the sidewall structure further comprises:

a first riser portion extending upwardly from the first external edge; and a second riser portion extending upwardly from the second external edge, and the first riser portion and the second riser portion are both substantially concave.

20. The container of claim 18, wherein:

the sidewall structure further comprises:

a first riser portion extending upwardly from the first external edge; and a second riser portion extending upwardly from the second external edge, and the first riser portion and the second riser portion are both substantially convex.

* * * * *